US008018476B2

(12) United States Patent
Credelle et al.

(10) Patent No.: US 8,018,476 B2
(45) Date of Patent: Sep. 13, 2011

(54) SUBPIXEL LAYOUTS FOR HIGH BRIGHTNESS DISPLAYS AND SYSTEMS

(75) Inventors: Thomas Lloyd Credelle, Morgan Hill, CA (US); Candice Hellen Brown Elliott, Santa Rosa, CA (US); Anthony Botzas, San Jose, CA (US)

(73) Assignee: Samsung Electronics Co., Ltd. (KR)

( * ) Notice: Subject to any disclaimer, the term of this patent is extended or adjusted under 35 U.S.C. 154(b) by 647 days.

(21) Appl. No.: 11/734,275

(22) Filed: Apr. 12, 2007

(65) Prior Publication Data

US 2008/0049048 A1 Feb. 28, 2008

Related U.S. Application Data

(63) Continuation-in-part of application No. 11/684,499, filed on Mar. 9, 2007, which is a continuation-in-part of application No. 11/467,916, filed on Aug. 28, 2006.

(51) Int. Cl.
*G09G 5/10* (2006.01)

(52) U.S. Cl. ..... 345/690; 345/87

(58) Field of Classification Search ..... 345/87, 345/690

See application file for complete search history.

(56) References Cited

U.S. PATENT DOCUMENTS

| | | | |
|---|---|---|---|
| 3,971,065 | A | 7/1976 | Bayer |
| 4,632,514 | A | 12/1986 | Ogawa et al. |
| 4,642,619 | A | 2/1987 | Togashi |
| 4,751,535 | A | 6/1988 | Myers |
| 4,786,964 | A | 11/1988 | Plummer et al. |
| 4,800,375 | A | 1/1989 | Silverstein et al. |
| 4,853,592 | A | 8/1989 | Stratham |
| 4,886,343 | A | 12/1989 | Johnson |
| 4,965,565 | A | 10/1990 | Noguchi |
| 5,006,840 | A | 4/1991 | Hamada et al. |
| 5,052,785 | A | 10/1991 | Takimoto et al. |
| 5,113,274 | A | 5/1992 | Takahashi et al. |
| 5,132,674 | A | 7/1992 | Bottorf |
| 5,196,924 | A | 3/1993 | Lumelsky et al. |
| 5,233,385 | A | 8/1993 | Sampsell |
| 5,311,205 | A | 5/1994 | Hamada et al. |
| 5,311,337 | A | 5/1994 | McCartney, Jr. |

(Continued)

FOREIGN PATENT DOCUMENTS

| | | | |
|---|---|---|---|
| CN | 1800934 | A | 7/2006 |

(Continued)

OTHER PUBLICATIONS

Adobe Systems, Inc. website, http://www.adobe.com/products/acrobat/cooltype.html.

(Continued)

*Primary Examiner* — Amare Mengistu
*Assistant Examiner* — Jennifer Zubajlo
(74) *Attorney, Agent, or Firm* — Innovation Counsel LLP

(57) ABSTRACT

A display device comprises a display panel comprising high brightness subpixel repeating groups—for example, RGBW display panels. Displays comprise subpixel repeating groups that include first and second primary color stripes and third and fourth primary color subpixels that are disposed on a checkerboard pattern. A subpixel rendering operation includes, or is followed by, a white subpixel adjustment operation that adjusts the brightness of the white subpixels in the areas of the displayed image that contain high spatial frequency features such as lines and text, in order to improve image quality such as image contrast.

8 Claims, 14 Drawing Sheets

U.S. PATENT DOCUMENTS 5,315,418 A 5/1994 Sprague et al.
5,334,996 A 8/1994 Tanigaki et al.
5,341,153 A 8/1994 Benzschawel et al.
5,398,066 A 3/1995 Martinez-Uriegas et al.
5,416,890 A 5/1995 Beretta
5,450,216 A 9/1995 Kasson
5,461,503 A 10/1995 Deffontaines et al.
5,485,293 A 1/1996 Robinder
5,541,653 A 7/1996 Peters et al.
5,563,621 A 10/1996 Silsby
5,724,442 A 3/1998 Ogatsu et al.
5,731,818 A 3/1998 Wan et al.
5,815,101 A 9/1998 Fonte
5,818,405 A 10/1998 Eglit et al.
5,821,913 A 10/1998 Mamiya
5,917,556 A 6/1999 Katayama
5,929,843 A 7/1999 Tanioka
5,933,253 A 8/1999 Ito et al.
5,949,496 A 9/1999 Kim
5,991,438 A 11/1999 Shaked et al.
6,008,868 A 12/1999 Silverbrook
6,023,315 A 2/2000 Harrold et al.
6,023,527 A 2/2000 Narahara
6,034,666 A 3/2000 Kanai et al.
6,049,626 A 4/2000 Kim
6,064,424 A 5/2000 Van Berkel
6,072,445 A 6/2000 Spitzer et al.
6,088,050 A 7/2000 Ng
6,097,367 A 8/2000 Kuriwaki et al.
6,108,053 A 8/2000 Pettitt et al.
6,108,122 A 8/2000 Ulrich et al.
6,137,560 A 10/2000 Utsumi et al.
6,144,352 A 11/2000 Matsuda et al.
6,188,385 B1 2/2001 Hill et al.
6,219,025 B1 4/2001 Hill et al.
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,256,425 B1 7/2001 Kunzman
6,262,710 B1 7/2001 Smith
6,278,434 B1 8/2001 Hill et al.
6,297,826 B1 10/2001 Semba et al.
6,326,981 B1 12/2001 Mori et al.
6,327,008 B1 12/2001 Fujiyoshi
6,332,030 B1 12/2001 Manjunath et al.
6,348,929 B1 2/2002 Acharya et al.
6,360,008 B1 3/2002 Suzuki et al.
6,360,023 B1 3/2002 Betrisey et al.
6,377,262 B1 4/2002 Hitchcock et al.
6,384,836 B1 5/2002 Naylor, Jr. et al.
6,385,466 B1 5/2002 Hirai et al.
6,392,717 B1 5/2002 Kunzman
6,393,145 B2 5/2002 Betrisey et al.
6,396,505 B1 5/2002 Lui et al.
6,441,867 B1 8/2002 Daly
6,453,067 B1 9/2002 Morgan et al.
6,459,419 B1 10/2002 Matsubayashi
6,466,618 B1 10/2002 Messing et al.
6,469,766 B2 10/2002 Waterman et al.
6,483,518 B1 11/2002 Perry et al.
6,486,923 B1 11/2002 Maeshima et al.
6,570,584 B1 5/2003 Cok et al.
6,577,291 B2 6/2003 Hill et al.
6,583,787 B1 6/2003 Pfister et al.
6,590,996 B1 7/2003 Reed et al.
6,593,981 B1 7/2003 Haim et al.
6,600,495 B1 7/2003 Boland et al.
6,614,414 B2 9/2003 De Haan et al.
6,624,828 B1 9/2003 Dresevic et al.
6,633,302 B1 10/2003 Ohsawa et al.
6,661,429 B1 12/2003 Phan
6,674,430 B1 1/2004 Kaufman et al.
6,674,436 B1 1/2004 Dresevic et al.
6,681,053 B1 1/2004 Zhu
6,714,243 B1 3/2004 Mathur et al.
6,724,934 B1 4/2004 Lee et al.
6,738,526 B1 5/2004 Betrisey et al.
6,750,874 B1 6/2004 Kim
6,750,875 B1 6/2004 Keely, Jr. et al.
6,771,028 B1 8/2004 Winters
6,781,626 B1 8/2004 Wang
6,801,220 B2 10/2004 Greier et al.
6,804,407 B2 10/2004 Weldy
6,833,890 B2 12/2004 Hong et al.
6,842,207 B2 1/2005 Nishida et al.
6,850,294 B2 2/2005 Roh et al.
6,856,704 B1 2/2005 Gallagher et al.
6,867,549 B2 3/2005 Cok et al.
6,870,523 B1 3/2005 Ben-David et al.
6,885,380 B1 4/2005 Primerano et al.
6,888,604 B2 5/2005 Rho et al.
6,897,876 B2 5/2005 Murdoch et al.
6,903,378 B2 6/2005 Cok
6,930,676 B2 8/2005 De Haan et al.
6,937,217 B2 8/2005 Klompenhouwer et al.
6,950,156 B1 9/2005 Yoshida
6,989,876 B2 1/2006 Song et al.
7,027,105 B2 4/2006 Lee et al.
7,110,012 B2 9/2006 Messing et al.
7,123,277 B2 10/2006 Brown Elliott et al.
7,184,066 B2 2/2007 Elliot et al.
7,184,067 B2 2/2007 Miller et al.
7,636,076 B2 12/2009 Hung et al.
2001/0048764 A1 12/2001 Betrisey et al.
2002/0030780 A1 3/2002 Nishida et al.
2002/0054263 A1 5/2002 Kim et al.
2002/0093476 A1 7/2002 Hill et al.
2002/0140831 A1 10/2002 Hayashi
2002/0191130 A1 12/2002 Liang et al.
2003/0011613 A1 1/2003 Booth, Jr.
2003/0034992 A1 2/2003 Brown Elliott et al.
2003/0071775 A1 4/2003 Ohashi et al.
2003/0085906 A1 5/2003 Elliott et al.
2003/0103058 A1 6/2003 Hellen Brown Elliott et al.
2003/0117457 A1 6/2003 Qiao
2003/0128179 A1 7/2003 Credelle
2003/0128225 A1 7/2003 Credelle et al.
2003/0128872 A1 7/2003 Lee et al.
2003/0146893 A1 8/2003 Sawabe
2003/0151694 A1 8/2003 Lee et al.
2003/0218618 A1 11/2003 Phan
2004/0008208 A1 1/2004 Dresevic et al.
2004/0021804 A1 2/2004 Hong et al.
2004/0036704 A1 2/2004 Han et al.
2004/0046725 A1 3/2004 Lee
2004/0051724 A1 3/2004 Elliott et al.
2004/0061710 A1 4/2004 Messing et al.
2004/0085495 A1 5/2004 Roh et al.
2004/0094766 A1 5/2004 Lee et al.
2004/0095521 A1 5/2004 Song et al.
2004/0114046 A1 6/2004 Lee et al.
2004/0150651 A1 8/2004 Phan
2004/0169807 A1 9/2004 Rho et al.
2004/0174389 A1 9/2004 Ben-David et al.
2004/0179160 A1 9/2004 Rhee et al.
2004/0189662 A1 9/2004 Frisken et al.
2004/0189664 A1 9/2004 Frisken et al.
2004/0196297 A1 10/2004 Elliott et al.
2004/0222999 A1 11/2004 Choi et al.
2004/0223005 A1 11/2004 Lee
2004/0239813 A1 12/2004 Klompenhouwer
2004/0239837 A1 12/2004 Hong et al.
2004/0263528 A1 12/2004 Murdoch et al.
2005/0031199 A1 2/2005 Ben-Chorin et al.
2005/0068477 A1 3/2005 Shin et al.
2005/0083341 A1 4/2005 Higgins et al.
2005/0083344 A1 4/2005 Higgins
2005/0083345 A1 4/2005 Higgins
2005/0083352 A1 4/2005 Higgins
2005/0083356 A1 4/2005 Roh et al.
2005/0088385 A1 4/2005 Elliott et al.
2005/0094871 A1 5/2005 Berns et al.
2005/0099540 A1 5/2005 Elliott et al.
2005/0122294 A1* 6/2005 Ben-David et al. ..... 345/87
2005/0151752 A1 7/2005 Phan

| | | | | |
|---|---|---|---|---|
| 2005/0169551 | A1 | 8/2005 | Messing et al. | |
| 2005/0190967 | A1 | 9/2005 | Ok et al. | |
| 2005/0212728 | A1 | 9/2005 | Miller et al. | |
| 2005/0219274 | A1 | 10/2005 | Yang et al. | |
| 2005/0225548 | A1 | 10/2005 | Han et al. | |
| 2005/0225561 | A1 | 10/2005 | Higgins et al. | |
| 2005/0225562 | A1 | 10/2005 | Higgins et al. | |
| 2005/0225574 | A1 * | 10/2005 | Brown Elliott et al. | 345/694 |
| 2005/0231534 | A1 | 10/2005 | Lee | |
| 2008/0049047 | A1 | 2/2008 | Credelle et al. | |

FOREIGN PATENT DOCUMENTS

| | | | |
|---|---|---|---|
| DE | 197 46 329 | A1 | 3/1999 |
| DE | 299 09 537 | U1 | 10/1999 |
| DE | 199 23 527 | | 11/2000 |
| EP | 0 322 106 | A2 | 6/1989 |
| EP | 0 793 214 | A1 | 2/1996 |
| EP | 0 899 604 | A2 | 3/1999 |
| JP | 62 127716 | | 6/1987 |
| JP | 02-000826 | A | 1/1990 |
| JP | 09-163162 | A | 6/1997 |
| JP | 11-014978 | | 1/1999 |
| JP | 2004-004822 | | 1/2004 |
| JP | 2004-078215 | A | 3/2004 |
| JP | 2004-102292 | A | 4/2004 |
| KR | 1020020080244 | A | 10/2002 |
| KR | 2003-0086399 | | 11/2003 |
| WO | WO 00/21067 | | 4/2000 |
| WO | WO 00/42564 | | 7/2000 |
| WO | WO 00/42762 | | 7/2000 |
| WO | WO 00/67196 | | 11/2000 |
| WO | WO 00/70392 | | 11/2000 |
| WO | WO 01/29817 | A1 | 4/2001 |
| WO | WO 01/37251 | A1 | 5/2001 |
| WO | WO 02/11112 | A2 | 2/2002 |
| WO | WO 03/056383 | A1 | 7/2003 |
| WO | WO 2004/021323 | A2 | 3/2004 |
| WO | WO 2004/027503 | A1 | 4/2004 |
| WO | WO 2004/086128 | A1 | 10/2004 |
| WO | WO 2005/050296 | A1 | 6/2005 |
| WO | WO 2005/057532 | A2 | 6/2005 |
| WO | WO 2005/065027 | A2 | 7/2005 |
| WO | WO 2005/076257 | A2 | 8/2005 |

OTHER PUBLICATIONS

Betrisey, C., et al., Displaced Filtering for Patterned Displays, SID Symp. Digest 1999, pp. 296-299.

Brown Elliott, C., "Active Matrix Display . . . ", IDMC 2000, 185-189, Aug. 2000.

Brown Elliott, C., "Color Subpixel Rendering Projectors and Flat Panel Displays," SMPTE, Feb. 27-Mar. 1, 2003, Seattle, WA pp. 1-4.

Brown Elliott, C, "Co-Optimization of Color AMLCD Subpixel Architecture and Rendering Algorithms," SID 2002 Proceedings Paper, May 30, 2002 pp. 172-175.

Brown Elliott, C, "Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002, pp. 115-117.

Brown Elliott, C, "Reducing Pixel Count Without Reducing Image Quality", Information Display Dec. 1999, vol. 1, pp. 22-25.

"ClearType magnified", Wired Magazine, Nov. 8, 1999, Microsoft Typography, article posted Nov. 8, 1999, last updated Jan. 27, 1999 1 page.

Credelle, Thomas, "P-00: MTF of High-Resolution PenTile Matrix Displays", Eurodisplay 02 Digest, 2002 pp. 1-4.

Daly, Scott, "Analysis of Subtriad Addressing Algorithms by Visual System Models",SID Symp. Digest, Jun. 2001 pp. 1200-1203.

E-Reader Devices and Software, Jan. 1, 2001, Syllabus, http://www.campus-technology.com/article.asp?id=419.

Feigenblatt, R.I., Full-color imaging on amplitude-quantized color mosaic displays, SPIE, 1989, pp. 199-204.

Feigenblatt, Ron, "Remarks on Microsoft ClearType™", http://www.geocities.com/SiliconValley/Ridge/6664/ClearType.html, Dec. 5, 1998, Dec. 7, 1998, Dec. 12, 1999, Dec. 26, 1999, Dec. 30, 1999 and Jun. 19, 2000, 30 pages.

Gibson, S., "Sub-Pixel Rendering; How it works," Gibson Research Corp., http://www.grc.com/ctwhat.html.

Klompenhouwer, Michiel, Subpixel Image Scaling for Color Matrix Displays, SID Symp. Digest, May 2002, pp. 176-179.

Michiel A. Klompenhouwer, Gerard de Haan, Subpixel image scaling for color matrix displays, Journal of the Society for Information Display, vol. 11, Issue 1, Mar. 2003, pp. 99-108.

Krantz, John et al., Color Matrix Display Image Quality: The Effects of Luminance . . . SID 90 Digest, pp. 29-32.

Lee, Baek-woon et al., 40.5L: Late-News Paper: TFT-LCD with RGBW Color system, SID 03 Digest, 2003, pp. 1212-1215.

Martin, R., et al., "Detectability of Reduced Blue-Pixel Count in Projection Displays," SID Symp. Digest, May 1993, pp. 606-609.

Messing, Dean et al., Improved Display Resolution of Subsampled Colour Images Using Subpixel Addressing, IEEE ICIP 2002, vol. 1, pp. 625-628.

Messing, Dean et al., Subpixel Rendering on Non-Striped Colour Matrix Displays, 2003 International Conf on Image Processing, Sep. 2003, Barcelona, Spain, 4 pages.

"Microsoft ClearType," website, Mar. 26, 2003, 4 pages.

Murch, M., "Visual Perception Basics," SID Seminar, 1987, Tektronix Inc, Beaverton Oregon.

Platt, John, Optimal Filtering for Patterned Displays, IEEE Signal Processing Letters, 2000, 4 pages.

PCT International Search Report dated Jun. 3, 2002 for PCT/US02/12610 (U.S. Appl. No. 10/051,612).

PCT International Search Report dated Sep. 30, 2003 for PCT/US02/24994 (U.S. Appl. No. 10/215,843).

PCT International Search Report dated Jun. 14, 2004 for PCT/US03/028222 (U.S. Appl. No. 10/243,094).

PCT International Search Report dated Jul. 11, 2005 for PCT/US05/010022 (U.S. Appl. No. 10/821,388).

PCT International Search Report dated Jul. 29, 2008 for PCT/US08/56241 (U.S. Appl. No. 11/684,499).

PCT International Search Report dated Aug. 21, 2008 for PCT/US08/59916 (U.S. Appl. No. 11/734,275).

Wandell, Brian A., Stanford University, "Fundamentals of Vision: Behavior . . . ," Jun. 12, 1994, Society for Information Display (SID) Short Course S-2, Fairmont Hotel, San Jose, California.

Werner, Ken, "OLEDS, OLEDS, Everywhere . . . ," Information Display, Sep. 2002, pp. 12-15.

European Search Report and Written Opinion for corresponding EP 2132588 dated Jul. 20, 2010 (8 pages).

* cited by examiner

SUBPIXEL LAYOUTS FOR HIGH BRIGHTNESS DISPLAYS AND SYSTEMS

This application is a continuation-in-part of U.S. patent application Ser. No. 11/684,499 filed on Mar. 9, 2007, and claims the benefit of priority thereof. U.S. patent application Ser. No. 11/684,499 is a continuation-in-part of U.S. patent application Ser. No. 11/467,916 filed on Aug. 28, 2006, and claims the benefit of priority thereof. U.S. Ser. No. 11/684,499 and U.S. Ser. No. 11/467,916 are each hereby incorporated by reference herein in its entirety.

BACKGROUND

Novel sub-pixel arrangements are disclosed for improving the cost/performance curves for image display devices in the following commonly owned United States Patents and Patent Applications including: (1) U.S. Pat. No. 6,903,754 ("the '754 Patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) United States Patent Publication No. 2004/0246381 ("the '381 application") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) United States Patent Publication No. 2004/0246278 ("the '278 application") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) United States Patent Publication No. 2004/0246279 ("the '279 application") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '381, '278, '404, '277 and '741 published applications are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) United States Patent Publication No. 2003/0034992 ("the '992 application") having application Ser. No. 10/051,612 and entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") having application Ser. No. 10/150,355 entitled "METHODS AND SYSTEMS FOR SUB-PIXEL RENDERING WITH GAMMA ADJUSTMENT," filed May 17, 2002; (3) United States Patent Publication No. 2003/0085906 ("the '906 application") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 Patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '992, '058, '906, '302, 380 and '297 applications and the '368 patent are hereby incorporated by reference herein in its entirety.

Improvements in gamut conversion and mapping are disclosed in commonly owned United States Patents and co-pending United States Patent Applications: (1) U.S. Pat. No. 6,980,219 ("the '219 Patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) United States Patent Publication No. 2005/0083344 ("the '344 application") having application Ser. No. 10/690,716 and entitled "GAMUT CONVERSION SYSTEM AND METHODS" filed Oct. 21, 2003. Each of the aforementioned '341, '352 and '344 applications and the '219 patent is hereby incorporated by reference herein in its entirety.

Additional advantages have been described in (1) United States Patent Publication No. 2005/0099540 ("the '540 application") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) United States Patent Publication No. 2005/0225563 ("the '563 application") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 200Y/AAAAAAA; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 200Y/BBBBBBB; (3) U.S. patent application Ser. No. 11/278,675, entitled "SYSTEMS AND METHODS FOR IMPLEMENTING IMPROVED GAMUT MAPPING ALGORITHMS" filed Apr. 4, 2006, and published as United States Patent Application Publication 2006/0244686; (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 200Y/DDDDDDD; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006 and published in the United States as United States Patent Application Publication 200Y/EEEEEEE (referred to below as the "Metamer Filtering application".) Each of these co-owned applications is also herein incorporated by reference in their entirety.

BRIEF DESCRIPTION OF THE DRAWINGS

The accompanying drawings are incorporated in, and constitute a part of this specification, and illustrate exemplary implementations and embodiments.

FIGS. 7*a*1 through 7*c*4 are various embodiments of the present application.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

The description that follows discusses several embodiments of subpixel arrangements or layouts that are suitable for high brightness display panels. These subpixel arrangements depart from the conventional RGB stripe layout, and some of the novel arrangements disclosed in many of the applications incorporated by reference above, in that many of the subpixel arrangements comprise stripes and checkerboards of colored subpixels.

Functional Overview of Display Device

Figure 1:
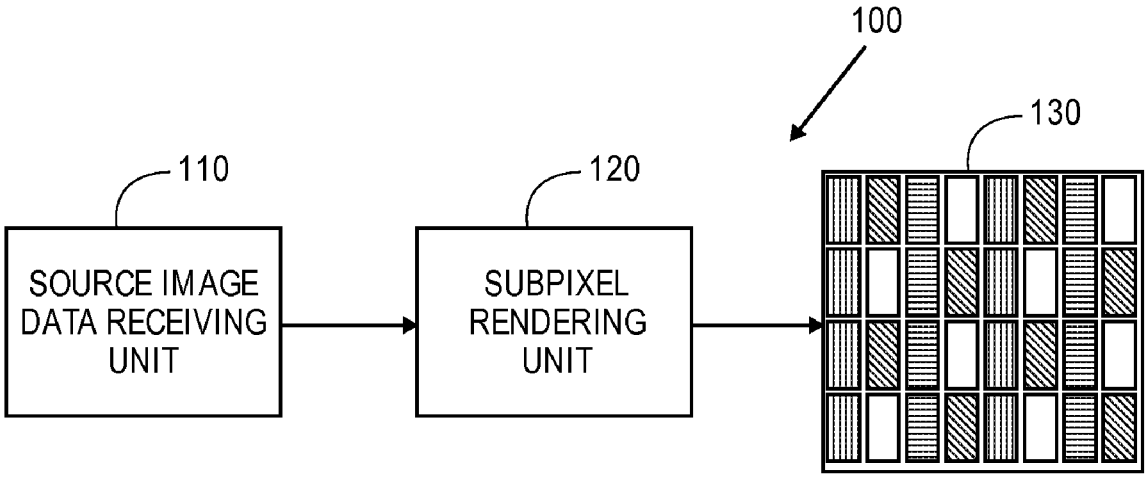
FIG. 1 is one embodiment of a display system comprising a display further comprising one embodiment of a novel subpixel layout.

FIG. 1 is a block diagram of a display device 100 which comprises a display panel 130 which may be manufactured to have any one of the embodiments of subpixel repeating groups shown in the present application, or any of the variations thereof discussed below. Display panel 130 substantially comprises a subpixel repeating group that is repeated across panel 130 to form a device with the desired matrix resolution. In this discussion, a display panel is described as "substantially" comprising a subpixel repeating group because it is understood that size and/or manufacturing factors or constraints of the display panel may result in panels in which the subpixel repeating group is incomplete at one or more of the panel edges. In addition, a display panel "substantially" comprises a given subpixel repeating group when the panel has a subpixel repeating group that is within a degree of symmetry, rotation and/or reflection, or any other insubstantial change, of one of the embodiments of a subpixel repeating group illustrated herein.

The subpixels on display panel 130 are individually addressable and produce light in one of a number of primary colors. The term "primary color" refers to each of the subpixel colors that occur in the subpixel repeating group. References to display systems or devices using more than three primary subpixel colors to form color images are referred to herein as "multi-primary" display systems. In a display panel having a subpixel repeating group that includes a white (clear) subpixel, such as those illustrated herein, the white subpixel represents a primary color referred to as white (W) or "clear", and so a display system with a display panel having a subpixel repeating group including RGBW subpixels is a multi-primary display system. As noted in commonly owned US 2005/0225563, color names are only "substantially" the colors described as, for example, "red", "green", "blue", "cyan", "yellow", "magenta" and "white" because the exact color points on the spectrum may be adjusted to allow for a desired white point on the display when all of the subpixels are at their brightest state.

With continued reference to FIG. 1, display device 100 also includes a source image data receiving unit 110 configured to receive source image data that indicates an image to be rendered on display panel 130. The source image data may be, but is not required to be, specified in a data format in which there is not a one-to-one mapping from a color value to a subpixel on display panel 130. By way of example, the format of the color image data values that indicate an input image may be specified as a two-dimensional pixel array of color image data in which each pixel element is specified as a red (R). green (G) and blue (B) triplet of data values, and each RGB triplet specifies a color at a pixel location in the input image. Display panel 130, when substantially comprising a plurality of a subpixel repeating group of the type described herein, specifies a different, or second, format in which the input image data is to be displayed. In the subpixel repeating group embodiments described herein, the subpixel repeating group is a two-dimensional (2D) multi-primary array of subpixels in which subpixels in at least first, second, third and fourth primary colors are arranged in at least two rows on display panel 130.

Display device 100 also may include a subpixel rendering unit 120 configured to perform a subpixel rendering operation that renders the image indicated by the source image data onto display panel 130. Subpixel rendering unit 120 may use subpixel rendering techniques as described below in conjunction with FIGS. 18 and 23. These subpixel rendering techniques expand on the subpixel rendering techniques described in commonly owned U.S. Pat. No. 7,123,277, U.S. 2005/0225575 and International Application PCT/US06/19657 published as WO International Patent Publication No. 2006/127555, as well as on techniques described in some of the other commonly-owned applications and issued patents that are incorporated by reference herein above.

Performing the operation of subpixel rendering the source image data produces a luminance value for each subpixel on display panel 130 such that the input image specified in the first format is displayed on the display panel comprising the second, different arrangement of primary colored subpixels in a manner that is aesthetically pleasing to a viewer of the image. As noted in U.S. Pat. No. 7,123,277, subpixel rendering operates by using the subpixels as independent pixels perceived by the luminance channel. This allows the subpixels to serve as sampled image reconstruction points as opposed to using the combined subpixels as part of a "true" (or whole) pixel. By using subpixel rendering, the spatial reconstruction of the input image is increased, and the display device is able to independently address, and provide a luminance value for, each subpixel on display panel 130.

Because the subpixel rendering operation renders information to display panel 130 at the individual subpixel level, the term "logical pixel" is introduced. A logical pixel may have an approximate Gaussian intensity distribution and overlaps other logical pixels to create a full image. Each logical pixel is a collection of nearby subpixels and has a target subpixel, which may be any one of the primary color subpixels, for which an image filter will be used to produce a luminance value. Thus, each subpixel on the display panel is actually used multiple times, once as a center, or target, of a logical pixel, and additional times as the edge or component of another logical pixel. A display panel substantially comprising a subpixel layout of the type disclosed herein and using the subpixel rendering operation described herein achieves nearly equivalent resolution and addressability to that of a convention RGB stripe display but with half the total number of subpixels and half the number of column drivers. Logical pixels are further described in commonly owned U.S. Patent Application Publication No. 2005/0104908 entitled "COLOR DISPLAY PIXEL ARRANGEMENTS AND ADDRESSING MEANS" (U.S. patent application Ser. No. 10/047,995), which is hereby incorporated by reference herein. See also Credelle et al., "MTF of High Resolution PenTile Matrix™ Displays," published in Eurodisplay 02 Digest, 2002, pp 1-4, which is hereby incorporated by reference herein.

Novel Subpixel Repeating Groups Comprising Stripes and Checkerboards

In the Figures herein that show examples of subpixel repeating groups, subpixels shown with vertical hatching are red (R), subpixels shown with diagonal hatching are green (G), subpixels 8 shown with horizontal hatching are blue (B), and subpixels shown with no hatching are white (W). Primary color subpixels other than RGBW are also identified with a hatching pattern explained below. When a single row or column on display panel 130 comprises subpixels of one primary color, the subpixels form a stripe within the subpixel repeating group and on display panel 130. When two rows or columns on display panel 130 each comprise subpixels of two primary colors in an alternating arrangement, the subpixels are said to form a "checkerboard pattern" within the subpixel repeating group. In the majority of the subpixel repeating groups illustrated herein, the subpixels of two of the primary colors are disposed in a checkerboard pattern. That is, a second primary color subpixel follows a first primary color in a first row of the subpixel repeating group, and a first primary color subpixel follows a second primary color in a second row of the subpixel repeating group. The checkerboard pattern describes the positions of two of the primary color subpixels without regard to the position of the other primary color subpixels in the subpixel repeating group. In addition, in the majority of the subpixel repeating groups illustrated herein, the subpixels of two of the primary colors form stripes. Thus, the embodiments of the subpixel layouts described herein substantially comprise a part striped and part checkerboard repeating pattern of subpixels.

Figure 2:
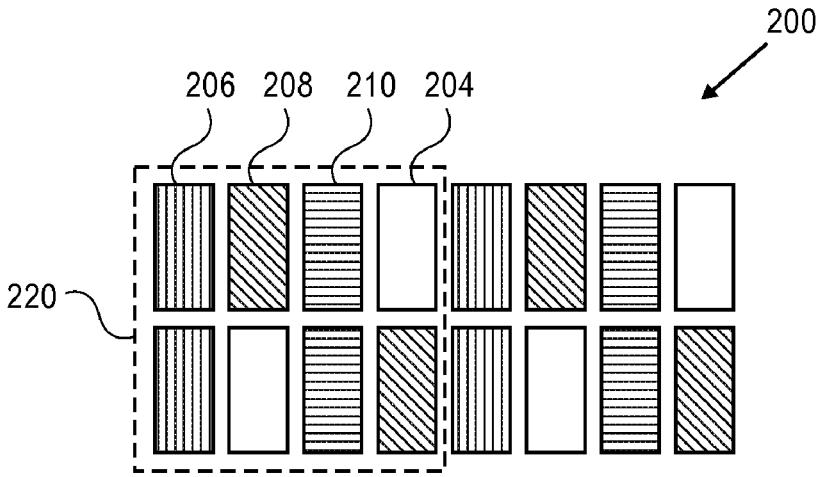
FIGS. 2-4 are embodiments of novel subpixel layouts comprising partial colored subpixel stripes and colored subpixel checkerboard pattern.
Figure 3:
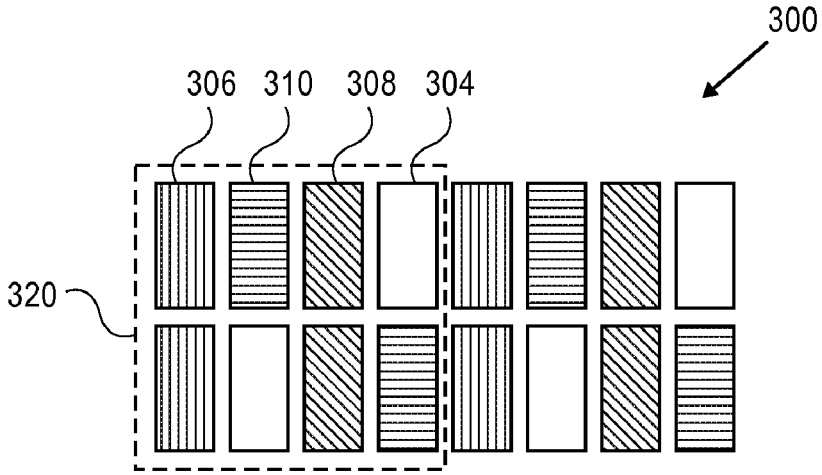
Figure 4:
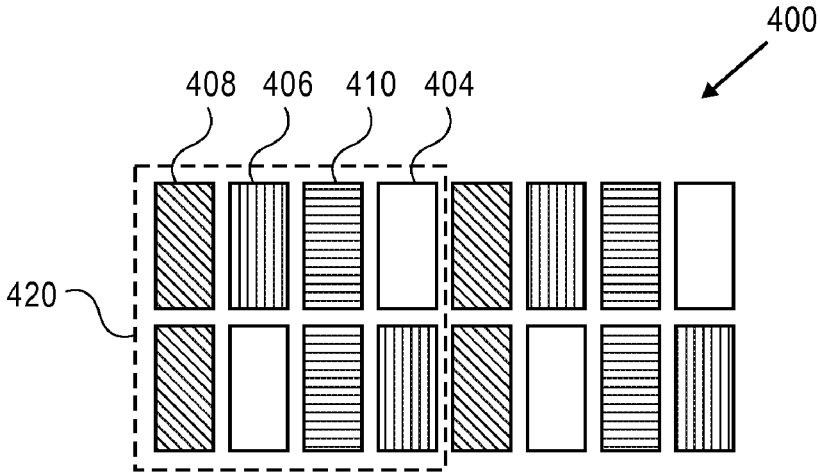

FIGS. 2, 3, and 4 illustrate subpixel repeating groups that were previously disclosed in parent application, U.S. Ser. No. 11/467,916. In general, each of the display panels of FIGS. 2, 3 and 4 comprise a plurality of subpixel repeating groups, each comprising eight subpixels of three primary colors and a fourth color arranged in first and second rows and forming four columns of subpixels. Each of the first and second rows comprises one subpixel in each of the three primary colors and the fourth color. Within each subpixel repeating group, two nonadjacent columns of single primary color subpixels form single primary color stripes on the display panel. In the remaining two nonadjacent columns within the subpixel repeating group, subpixels in the third and fourth primary colors alternate down each column. The subpixels in the third and fourth primary colors are disposed on a checkerboard pattern as previously defined. By way of example, in FIG. 2, columns of red subpixels 206 and columns of blue subpixels 210 form stripes within the subpixel repeating group 220, and columns containing alternating instances of white subpixels 204 and green subpixels 208 form a checkerboard pattern as defined herein.

FIG. 2 illustrates a portion 200 of a display panel comprising eight subpixel repeating group 220. In subpixel repeating group 220, the red subpixel 206 (shown with vertical hatching) and the blue subpixel 210 (shown with horizontal hatching) are disposed in vertical stripes, while the green subpixel 208 (shown with diagonal hatching) and the white subpixel 204 (shown with no hatching) are disposed on a checkerboard pattern.

FIG. 3 illustrates a portion 300 of a display panel comprising eight subpixel repeating group 320. In subpixel repeating group 320, the red subpixel 306 and the green subpixel 308 are disposed in vertical stripes, while the blue subpixel 310 and the white subpixel 304 are disposed on a checkerboard pattern.

FIG. 4 illustrates a portion 400 of a display panel comprising eight subpixel repeating group 420. In subpixel repeating group 420, the green subpixel 408 and the blue subpixel 410 are disposed in vertical stripes, while the red subpixel 406 and the white subpixel 404 are disposed on a checkerboard pattern.

Variations of each of the subpixel repeating groups shown in FIGS. 2-4 are also possible. For example, each of the display panels could be configured with a subpixel repeating group of one of FIGS. 2-4 in which the subpixels have aspect ratios different from that shown in these figures, or in which the subpixels have a substantially square shape, as opposed to the rectangular shape shown in the figures. In another variation, the first and second rows of the subpixel repeating group in each figure could be switched. In such a modified subpixel arrangement, the first row of the subpixel repeating group 220 of FIG. 2 would be arranged as R (red), W (white) B (blue) and G (green), and the second row of subpixel repeating group 220 could be arranged as R, G, B and W. In another variation, each of the display panels could be configured with a subpixel repeating group of one of FIGS. 2-4 in which the subpixel repeating group is rotated ninety degrees (90°) to the left or right, or otherwise translated into a different orientation. In another variation, each of the display panels could be configured with a subpixel repeating group of one of FIGS. 2-4 in which the subpixels in the striped columns are made smaller or larger than the subpixels in the columns including the white subpixels, or are offset from adjacent columns. A person of skill in the art will appreciate that many types of mirror images and symmetrical transformations of the subpixel repeating groups shown in FIGS. 2-4 are possible. Many of these types of variations, as applied to different subpixel repeating groups, are illustrated in US 2005/0225574 entitled "Novel Subpixel Layouts and Arrangements for High Brightness Displays" which is incorporated by reference herein.

Figure 5:
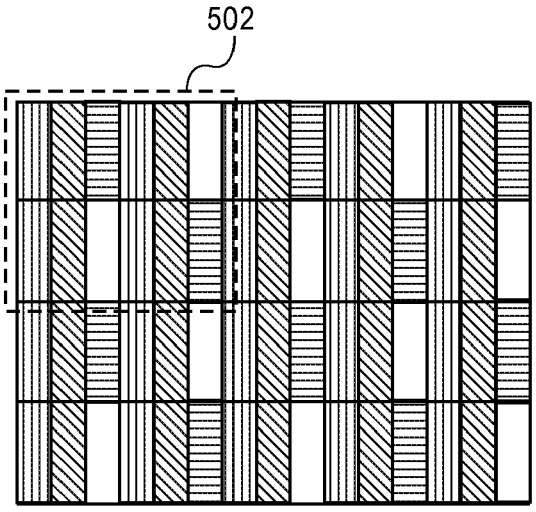
FIG. 5 is another embodiment of a novel subpixel layout comprising partial colored subpixel stripes and colored subpixel checkerboard pattern.

FIG. 5 depicts another embodiment of a novel display. Subpixel repeating group 502 comprises two rows of six (6) subpixels in four primary colors forming six columns. In general, two pairs of two adjacent columns of first and second primary color subpixels each form a stripe of single primary color subpixels on the display panel. Following each pair of two adjacent columns of first and second primary color subpixels is a column of alternating third and fourth primary color subpixels, with the third and fourth primary color subpixels disposed on a checkerboard pattern as defined above. That is, in the first row of subpixel repeating group 502, the fourth primary color subpixel follows the third primary color subpixel, and in the second row of subpixel repeating group 502, the third primary color subpixel follows the fourth primary color subpixel. Specifically with respect to subpixel repeating group 502 of FIG. 5, two pairs of two adjacent columns of red and green subpixels each form a stripe of single primary color subpixels on the display panel. Following each pair of two adjacent columns of red and green subpixels is a column of alternating white and blue subpixels. The alternating blue and white subpixels are disposed on a checkerboard pattern such that, in the first row of subpixel repeating group 502, the white subpixel follows the blue subpixel, and in the second row of subpixel repeating group 502, the blue subpixel follows the white subpixel.

Figure 7:
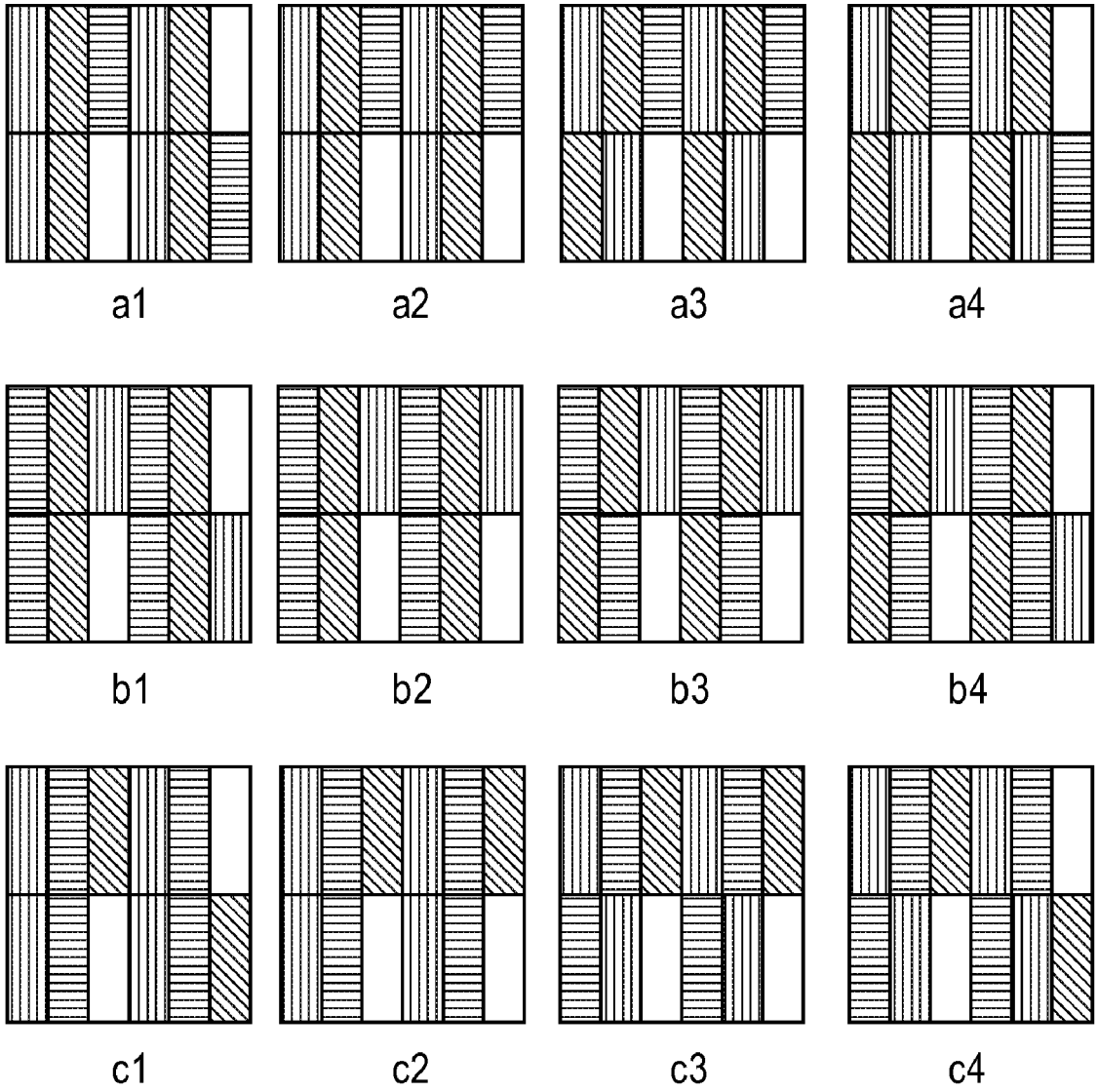

FIG. 7 is a collection of subpixel repeating groups that illustrate several additional embodiments of subpixel repeating group 502. Any one of these variations, when repeated across a panel, may also substantially comprise a display panel. FIG. 7*a*1 illustrates subpixel repeating group 502. FIGS. 7*b*1 and 7*c*1 illustrate subpixel repeating groups which conform to the general description of subpixel repeating group 502 above, where first and second primary color subpixels are disposed in single-primary color columns that form stripes, and third and fourth primary color subpixels are disposed on a checkerboard pattern. FIGS. 7*a*2, 7*b*2 and 7*c*2 illustrate subpixel repeating groups in which first and second primary color subpixels are disposed in single-primary color columns that form stripes, but third and fourth primary color subpixels uniformly alternate in their respective columns. For practical reasons, not all possible variations are illustrated in the figures. However, a person of skill in the art will appreciate that other embodiments not shown are also encompassed herein. For example, the order of the primary color stripes may be exchanged (e.g., in FIG. 7*a*1, the red stripe of subpixels may follow the green stripe of subpixels). Or in the subpixel repeating groups where the third and fourth primary colors are disposed in the checkerboard pattern, the checkerboard pattern may be mirror-imaged. That is, in FIG. 7*b*1 for example, the columns of alternating red and white subpixels disposed on the checkerboard pattern may be modified to be columns of alternating white and red subpixels disposed on the checkerboard pattern.

Moreover, these subpixel repeating groups may be implemented in horizontal arrangements as well as in the vertical arrangements illustrated in the Figures. This implementation embodiment comprises two subsets of subpixel repeating group variations. In one subset, the aspect ratio of the subpixels is changed such that the subpixels are longer on their horizontal axis than on their vertical axis. In a second subset, the column drivers that provide image data signals to columns of subpixels and the row drivers commonly called gate drivers may be interchanged to become row data drivers and column gate drivers.

The various embodiments of subpixel repeating groups illustrated in the figures depict the subpixels having a 1:3 aspect ratio. Subpixels in conventional commercial liquid crystal display (LCD) panels that employ a conventional RGB stripe display in which the subpixel repeating group of R, G, and B subpixels is repeated across the display panel are typically constructed using aspect ratio of 1:3. Thus, it may be desirable to use the same 1:3 aspect ratio for the subpixels of a display panel comprising one of the illustrated embodiments herein in order to employ the same TFT backplane and/or drive circuitry that is used in the conventional RGB stripe display. When a display panel substantially comprises subpixel repeating group 502 (e.g., display panel 130 of FIG. 1) is compared to a conventional RGB stripe display of the same resolution, it can be seen that display panel 130 comprises the same number of red and green subpixels as the conventional RGB stripe display panel. Display panel 130 also comprises half the number of blue subpixels as the conventional RGB stripe display panel, with the other half of the blue subpixels of the conventional RGB stripe display panel being replaced with white subpixels on display panel 130. With respect to choice of aspect ratio, however, a person of skill in the art will appreciate that the subpixel repeating groups illustrated and disclosed herein may be of any suitable aspect ratio without limitation, such as, for example, 1:1, 1:2, 2:1 and 2:3.

Additionally, for displays having a dots-per-inch (dpi) of less than a certain dpi (e.g. 250 dpi), these part-stripe, part-checkerboard subpixel arrangements in a 1:3 aspect ratio may improve the performance of black fonts on color backgrounds, because black fonts on colored backgrounds may not appear as serrated.

Figure 6:
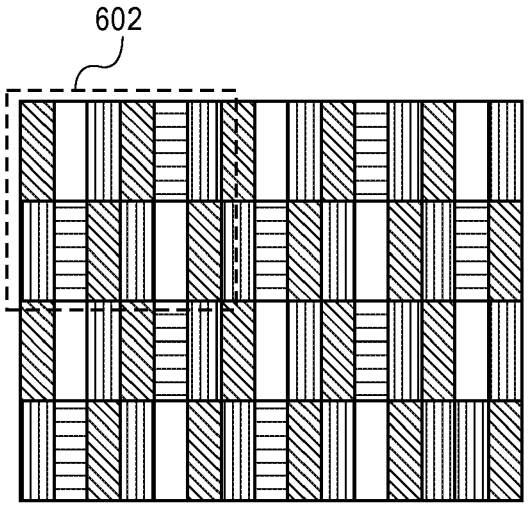
FIG. 6 is one embodiment of a novel subpixel layout in a 1:3 aspect ratio.

FIG. 6 is a display (substantially comprising repeating group 602) that is not of the part-striped, part-checkerboard pattern; but would have the same number of red and green colored subpixels as a comparable RGB stripe display of 1:3 aspect ratio. The display of FIG. 6 would again have full resolution in two colors and half resolution in third color and added white subpixel. The same is seen for the displays of FIGS. 7*a*3-*a*4, 7*b*3-*b*4 and 7*c*3-*c*4 where the fully sampled colors are not always red and green, but can be red and blue or green and blue. Of course, the present application encompasses embodiments in which all symmetries and mirror images of assigned color subpixels may be made.

In all of the displays of FIGS. 5-7, the decreased number of blue subpixels (as compared to the conventional RGB stripe display) may cause a color shift in the displayed image unless the transmissivity of the blue subpixel is increased or the backlight is modified to have a more bluish color point. In one embodiment, the blue filter could to be adjusted to have higher transmission (e.g. ~2×) to balance for the loss of blue. Another embodiment may utilize more saturated red and green subpixels which have less transmission and therefore may balance the blue to create a more desirable white point. A combination of fixes may also be used—i.e. change both the color filters and the backlight.

Figure 8A:
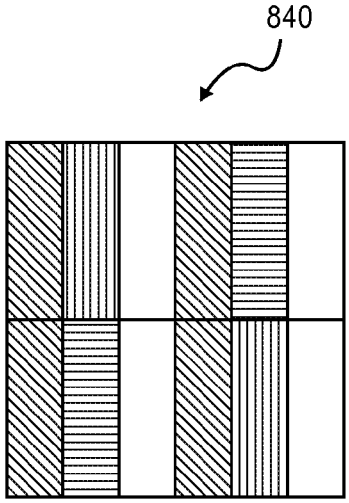
FIGS. 8A through 8C are various embodiments comprising a white stripe and a stripe of one primary color.
Figure 8B:
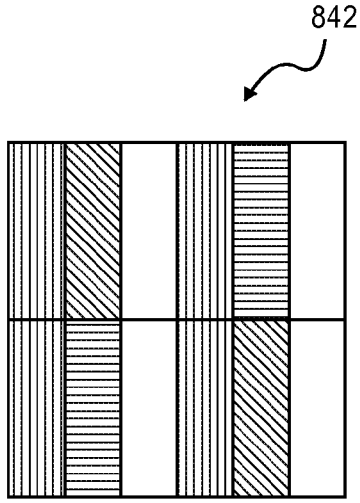
Figure 8C:
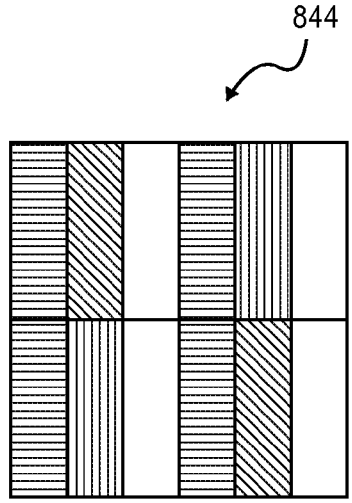

In the illustrated embodiments of FIGS. 5, 6 and 7, the first and second primary colors that are disposed in columns to form stripes are both saturated primary colors. For applications where brightness is paramount and color detail is not as important, alternative subpixel repeating groups are shown in FIGS. 8A, 8B, and 8C. In these layouts, the white (nonsaturated) subpixel is one of primary colors disposed in columns to form white stripes, along with the second saturated primary color that forms a stripe. Note that in these embodiments the overall white brightness of the display panel may be high, but the pure (saturated) colors may also appear darker since white is so high. These layouts may be appropriate for transflective displays where high reflectivity is desirable. As discussed above, variations of the embodiments of subpixel repeating groups shown in FIGS. 8A, 8B, and 8C, such as symmetric and mirror image subpixel repeating groups, are also contemplated and encompassed in the present application.

Figure 9:
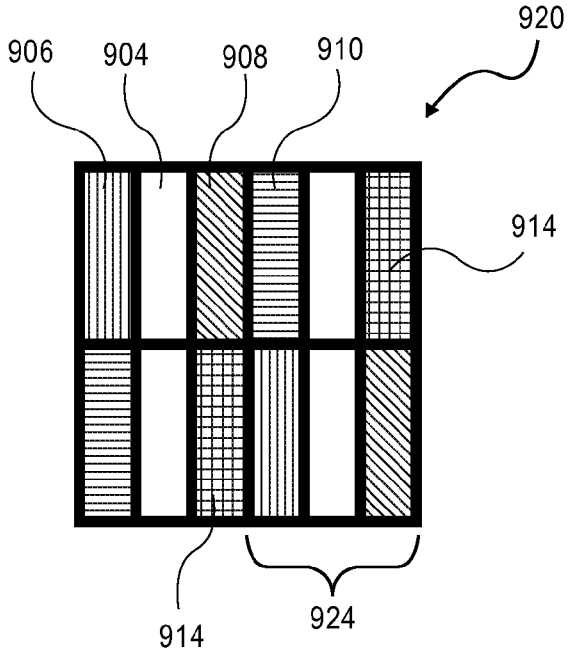
FIG. 9 is one embodiment of a subpixel layout comprising white stripes and a fourth color primary.

FIG. 9 depicts another subpixel arrangement design. In this case, the white subpixel may be striped and, instead of another primary color stripe, a substitution of another color (e.g. yellow, cyan, magenta), as shown in the square hatching, may be employed. If a bright color (e.g. yellow) is employed, then this design layout may be very bright since it has a white subpixel in every logical pixel (three subpixels per logical pixel on average). The logical pixels are very nearly balanced in luminance, the yellow being the same brightness as the red and green (R+G=Y).

Note also that the concept of a checkerboard pattern may be extended to pairs of subpixels. For example, in twelve-subpixel subpixel repeating group 910 of FIG. 9, the pair of red subpixels 906 and white subpixels 904 are disposed in opposing positions in the first and second rows of the subpixel repeating group, and the pair of blue subpixels 910 and white subpixels 904 are disposed in opposing positions in the first and second rows of the subpixel repeating group. Twelve-subpixel subpixel repeating group 910 may be said to have pairs of red and white subpixels and pairs of blue and white subpixels disposed on a checkerboard. Of course, the present application encompasses other variations of color subpixel assignment to include, for example, symmetries and mirror-images and the like. In addition, another variation would be to have the white subpixel and the fourth colored subpixel change places. In such a case, the fourth colored primary may be the stripe and the white subpixel may be in a checkerboard with another color primary.

Figure 10:
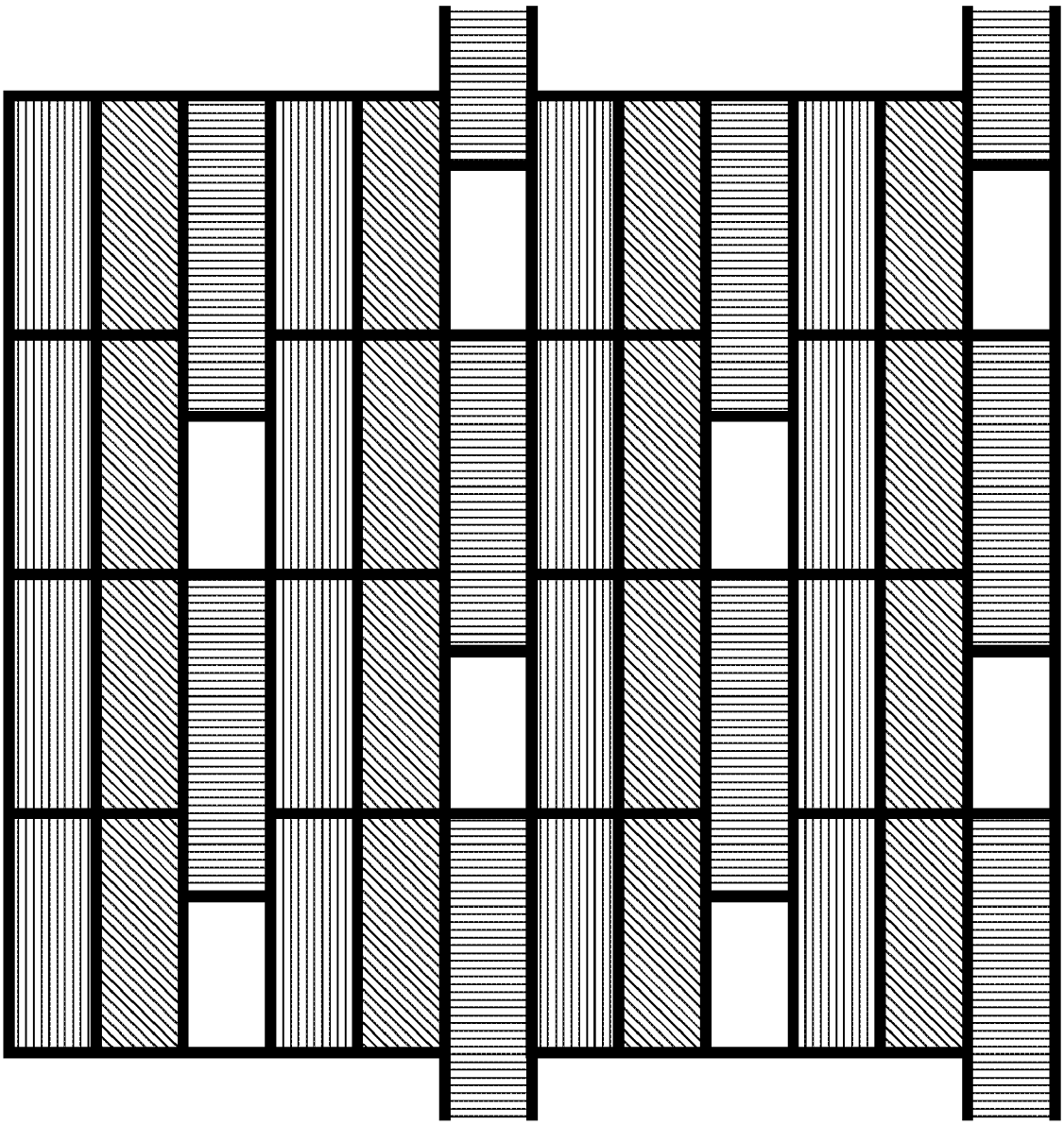
FIGS. 10, and 11A-11B are embodiments comprising a larger blue subpixel and a diminished white subpixel.
Figure 11A:
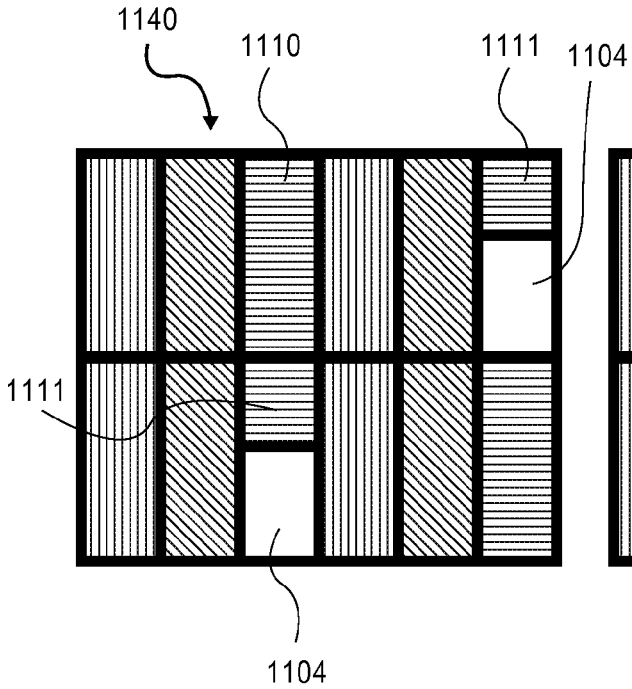
Figure 11B:
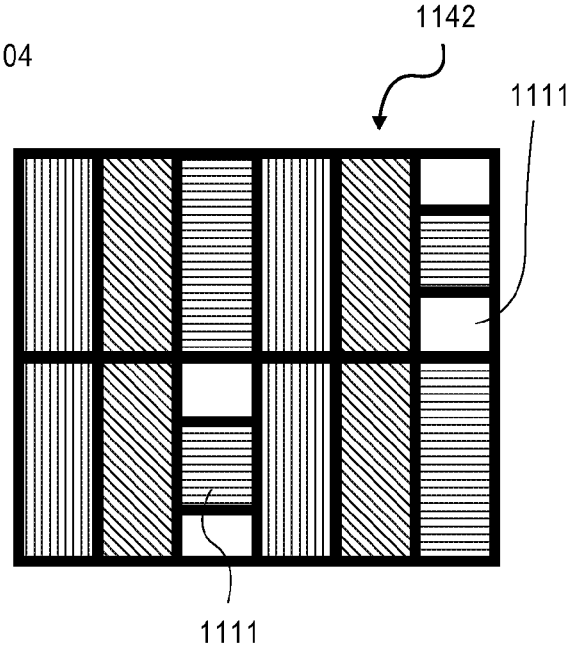

As already mentioned, it may be necessary to rebalance the color filter and backlight to achieve a desired white point for the entire display panel. This can be done by increasing the transmission of the blue filter by making it thinner or by using different pigments/dyes. Another method to adjust the white point is to adjust the size of the blue and white subpixels, either together or separately. In FIG. 10, the blue subpixel is expanded in size at the expense of the white subpixel. The gate line may need to "zig-zag" or cross the blue subpixel in such a design. Another embodiment is shown in FIGS. 11A and 11B. The white subpixel is partially covered by the blue filter material. This drops the white transmission slightly, but also shifts the white point in the blue direction. In FIG. 11B, the blue portion of white can be placed anywhere on the white subpixel such as shown.

Figure 12A:
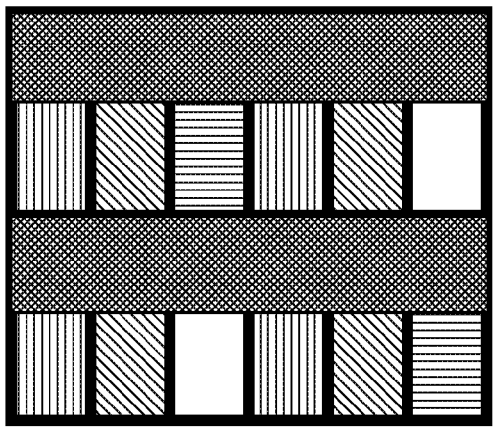
FIGS. 12A and 12B are embodiments of transflective subpixel layouts.
Figure 12B:
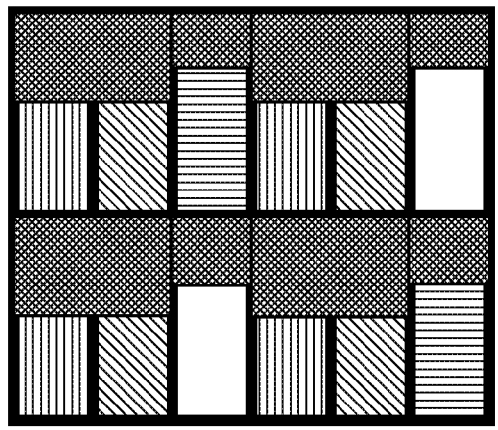

Another method to adjust the white point can be done with transflective designs. The amount of blue and white can be adjusted by setting the area for reflector and transmitter portion of each. FIG. 12A shows one embodiment of FIG. 5 having a transflective portion (noted by the cross hatched region which may also assume the color assignment of the transmissive portion. FIG. 12B shows is yet another embodiment that tends to change the white point of the display when in transmissive mode. The reflector portion for blue and white can also be adjusted differently so as to create different white point for transmission mode and reflection mode. It should be understood that various combinations of reflector sizes can be used to change both the transmissive and reflective white points.

Figure 13:
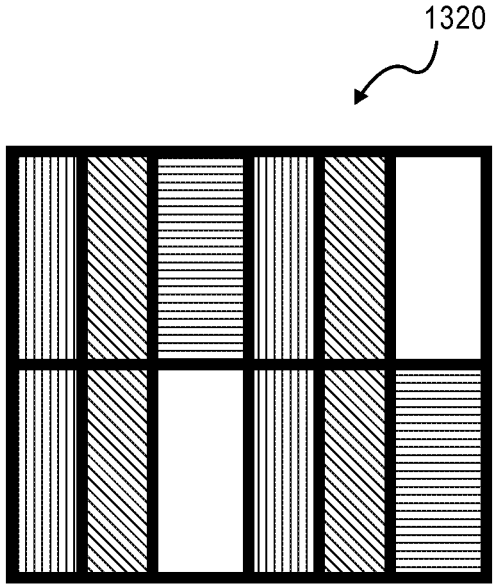
FIGS. 13, 14 and 15 are embodiments of layouts have larger blue subpixels in various configurations.
Figure 14:
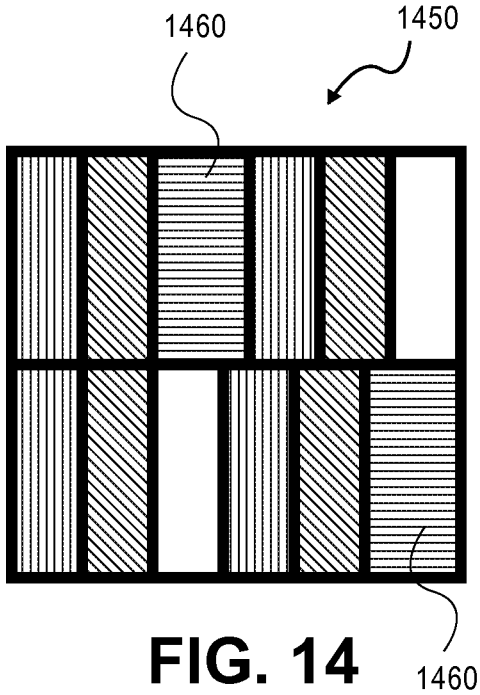
Figure 15:
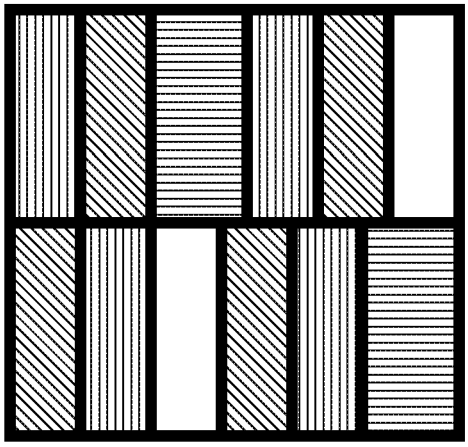

FIGS. 13, 14 and 15 depict embodiments in which the amount of blue is adjusted relative to the size of the other subpixels. FIG. 13 shows both W and B with wider subpixels. FIG. 14 shows only the blue subpixel larger that all other subpixels. In the latter case, there will be a slight zigzag appearance of RG pixels. In this case, it may be preferable to place the red and green subpixels on a checkerboard pattern so as to hide the small shift in stripe location, as is shown in FIG. 15.

Display System Features

Figure 16A:
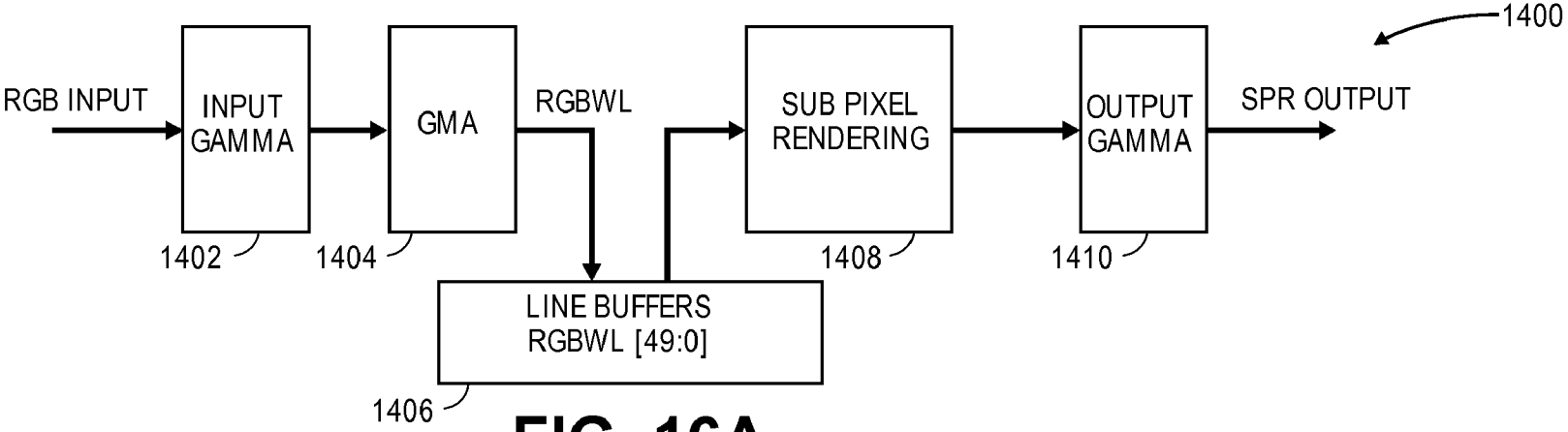
FIGS. 16A and 16B are block diagrams showing the functional components of two embodiments of display devices that perform subpixel rendering operations.
Figure 16B:
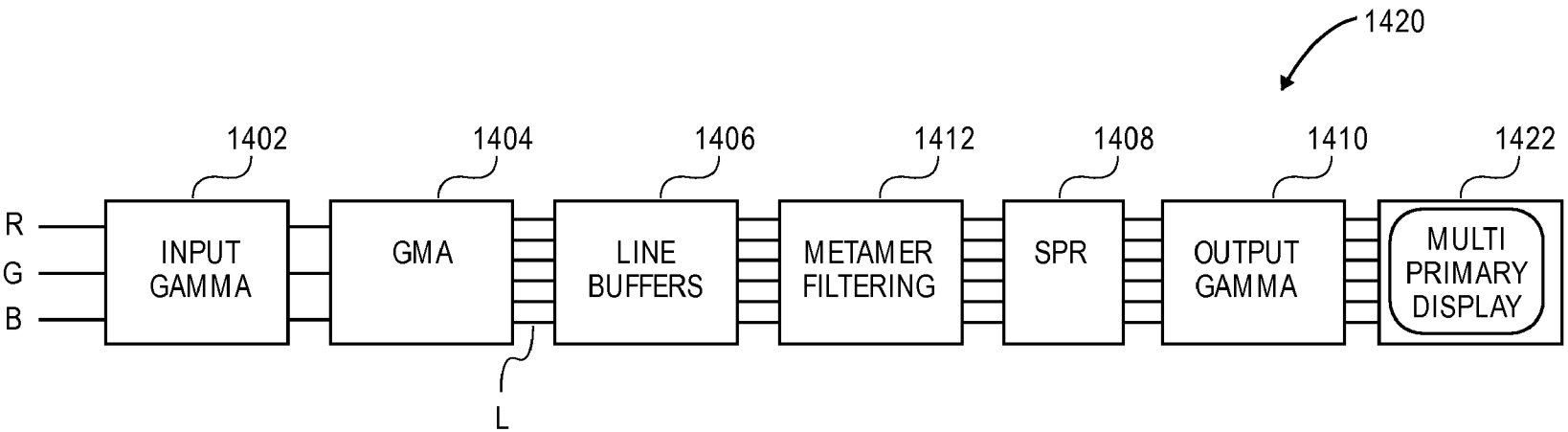

FIGS. 16A and 16B illustrate the functional components of embodiments of display devices and systems that implement display panels configured with subpixel repeating groups illustrated in the figures herein, and that implement the subpixel rendering operations as described below and in other commonly owned patent applications and issued patents variously referenced herein. FIG. 16A illustrates display system 1400 with the data flow through display system 1400 shown by the heavy lines with arrows. Display system 1400 comprises input gamma operation 1402, gamut mapping (GMA) operation 1404, line buffers 1406, SPR operation 1408 and output gamma operation 1410.

Input circuitry provides RGB input data or other input data formats to system 1400. The RGB input data may then be input to Input Gamma operation 1402. Output from operation 1402 then proceeds to Gamut Mapping operation 1404. Typically, Gamut Mapping operation 1404 accepts image data and performs any necessary or desired gamut mapping operation upon the input data. For example, when the image processing system is inputting RGB input data for rendering upon a RGBW display panel of the type illustrated and described herein, then a mapping operation may be desirable in order to use the white (W) primary of the display. This operation might also be desirable in any general multiprimary display system where input data is going from one color space to another color space with a different number of primaries in the output color space. Additionally, a GMA might be used to handle situations where input color data might be considered as "out of gamut" in the output display space. Additional information about gamut mapping operations suitable for use in multiprimary displays may be found in commonly-owned U.S. patent applications which have been published as U.S. Patent Application Publication Nos. 2005/0083352, 2005/0083341, 2005/0083344 and 2005/0225562, all of which are incorporated by reference herein.

With continued reference to FIG. 16A, intermediate image data output from Gamut Mapping operation 1404 is stored in line buffers 1406. Line buffers 1406 supply subpixel rendering (SPR) operation 1408 with the image data needed for further processing at the time the data is needed. For example, an SPR operation that implements the area resample principles disclosed and described below typically may employ a 3×3 matrix of image data surrounding a given image data point being processed in order to perform area resampling. Thus, three data lines are input into SPR 1408 to perform a subpixel rendering operation that may involve neighborhood filtering steps. However, it is to be understood that the image filters may employ a larger matrix, and may require more line buffers to store the data. After SPR operation 1408, image data may be subject to an output Gamma operation 1410 before being output from the system to a display. Note that both input gamma operation 1402 and output gamma operation 1410 may be optional. Additional information about this display system embodiment may be found in, for example, commonly owned United States Patent Application Publication No. 2005/0083352. The data flow through display system 1400 may be referred to as a "gamut pipeline" or a "gamma pipeline."

FIG. 16B shows a system level diagram 1420 of one embodiment of a display system that employs the techniques discussed in commonly owned international application published as WO 2006/127555 for subpixel rendering input image data to multiprimary display 1422. Functional components that operate in a manner similar to those shown in FIG. 16A have the same reference numerals. Input image data may consist of 3 primary colors such as RGB or YCbCr that may be converted to multi-primary in GMA module 1404. In display system 1420, GMA component 1404 may also calculate the luminance channel, L, of the input image data signal—in addition to the other multi-primary signals. In display system 1420, the metamer calculations may be implemented as a filtering operation which involves referencing a plurality of surrounding image data (e.g. pixel or subpixel) values. These surrounding values are typically organized by line buffers 1406, although other embodiments are possible, such as multiple frame buffers. Display system 1420 comprises a metamer filtering module 1412 which performs operations as briefly described above, and as described in more detail in WO 2006/127555. In one embodiment of display system 1420, it is possible for metamer filtering operation 1412 to combine its operation with sub-pixel rendering (SPR) module 1408 and to share line buffers 1406. This embodiment is called "direct metamer filtering".

Figure 17:
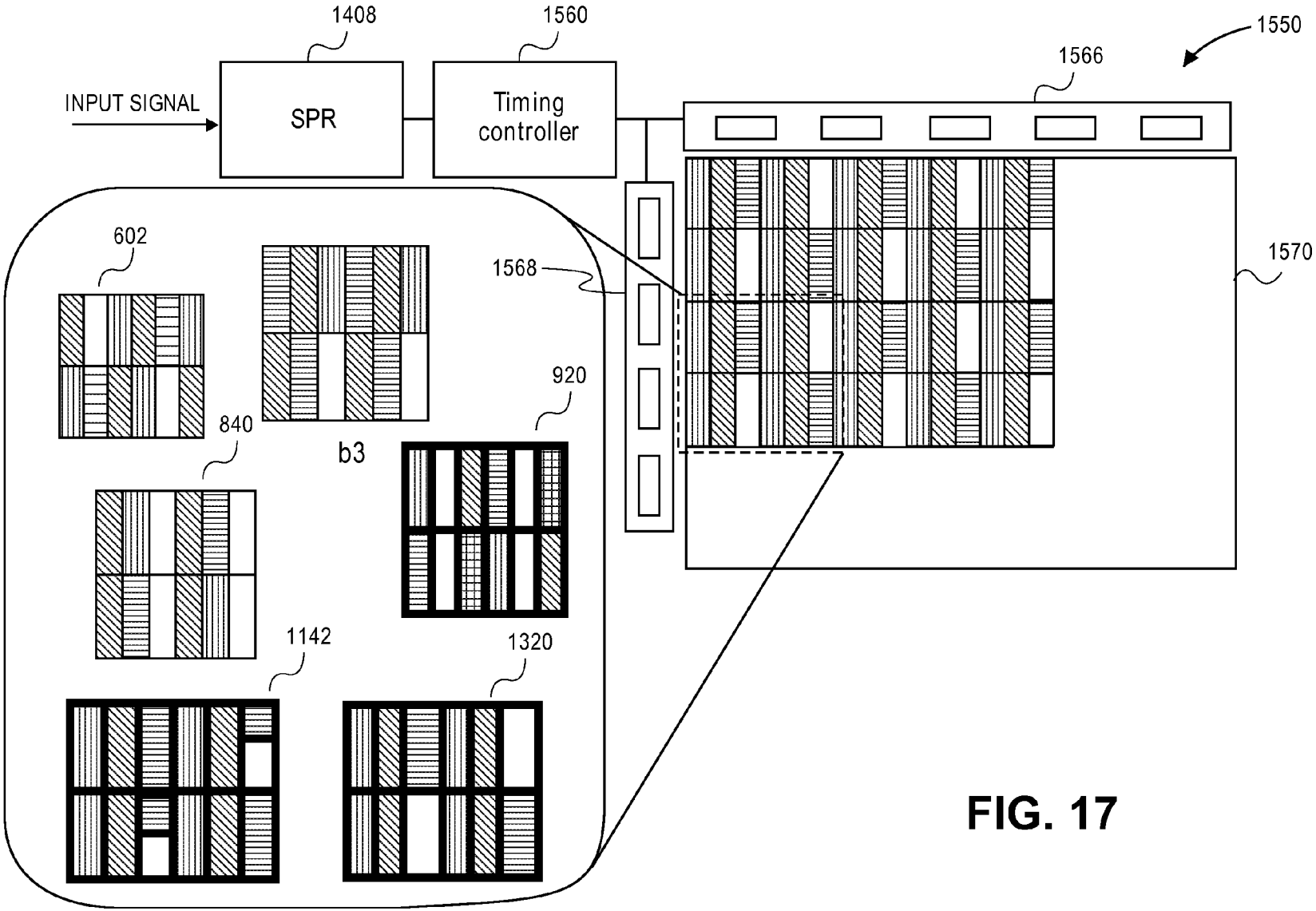
FIG. 17 is a block diagram of a display device architecture and schematically illustrating simplified driver circuitry for sending image signals to a display panel comprising one of several embodiments of a subpixel repeating group.

FIG. 17 provides an alternate view of a functional block diagram of a display system architecture suitable for implementing the techniques disclosed herein. Display system 1550 accepts an input signal indicating input image data. The signal is input to SPR operation 1408 where the input image data may be subpixel rendered for display. While SPR operation 1408 has been referenced by the same reference numeral as used in the display systems illustrated in FIGS. 16A and 16B, it is understood that SPR operation 1408 may include any modifications to, or enhancements of, SPR functions that are discussed herein.

With continued reference to FIG. 17, in this display system architecture, the output of SPR operation 1408 may be input into a timing controller 1560. Display system architectures that include the functional components arranged in a manner other than that shown in FIG. 17 are also suitable for display systems contemplated herein. For example, in other embodiments, SPR operation 1408 may be incorporated into timing controller 1560, or may be built into display panel 1570 (particularly using LTPS or other like processing technologies), or may reside elsewhere in display system 1550, for example, within a graphics controller. The particular location of the functional blocks in the view of display system 1550 of FIG. 17 is not intended to be limiting in any way.

In display system 1550, the data and control signals are output from timing controller 1560 to driver circuitry for sending image signals to the subpixels on display panel 1570. In particular, FIG. 17 shows column drivers 1566, also referred to in the art as data drivers, and row drivers 1568, also referred to in the art as gate drivers, for receiving image signal data to be sent to the appropriate subpixels on display panel 1570. Display panel 1570 substantially comprises a subpixel repeating grouping 502 of FIG. 5, which is comprised of a two row by six column subpixel repeating group having four primary colors including white (clear) subpixels. It should be appreciated that the subpixels in repeating group 502 are not drawn to scale with respect to display panel 1570; but are drawn larger for ease of viewing. As shown in the expanded view, display panel 1570 may substantially comprise other subpixel repeating groups as shown. It is understood that the subpixel repating groups shown in FIG. 17 are only representative, and display panel 1570 may comprise any of the subpixel repeating groups illustrated and described herein. One possible dimensioning for display panel 1570 is 1920 subpixels in a horizontal line (640 red, 640 green and 640 blue subpixels) and 960 rows of subpixels. Such a display would have the requisite number of subpixels to display VGA, 1280×720, and 1280×960 input signals thereon. It is understood, however, that display panel 1570 is representative of any size display panel.

Various aspects of the hardware implementation of the displays described above is also discussed in commonly-owned US Patent Application Publication Nos. US 2005/0212741 (U.S. Ser. No. 10/807,604) entitled "TRANSISTOR BACKPLANES FOR LIQUID CRYSTAL DISPLAYS COMPRISING DIFFERENT SIZED SUBPIXELS," US 2005/0225548 (U.S. Ser. No. 10/821,387) entitled "SYSTEM AND METHOD FOR IMPROVING SUB-PIXEL RENDERING OF IMAGE DATA IN NON-STRIPED DISPLAY SYSTEMS," and US 2005/0276502 (U.S. Ser. No. 10/866,447) entitled "INCREASING GAMMA ACCURACY IN QUANTIZED SYSTEMS," all of which are hereby incorporated by reference herein. Hardware implementation considerations are also described in International Application PCT/US06/12768 published as International Patent Publication No. WO 2006/108084 entitled "EFFICIENT MEMORY STRUCTURE FOR DISPLAY SYSTEM WITH NOVEL SUBPIXEL STRUCTURES," which is also incorporated by reference herein. Hardware implementation considerations are further described in an article by Elliott et al. entitled "Co-optimization of Color AMLCD Subpixel Architecture and Rendering algorithms," published in the SID Symposium Digest, pp. 172-175, May 2002, which is also hereby incorporated by reference herein.

The techniques discussed herein may be implemented in all manners of display technologies, including transmissive and non-transmissive display panels, such as Liquid Crystal Displays (LCD), reflective Liquid Crystal Displays, emissive ElectroLuminecent Displays (EL), Plasma Display Panels (PDP), Field Emitter Displays (FED), Electrophoretic displays, Iridescent Displays (ID), Incandescent Display, solid state Light Emitting Diode (LED) display, and Organic Light Emitting Diode (OLED) displays.

Subpixel Rendering Techniques

Commonly owned U.S. Pat. No. 7,123,277 entitled "CONVERSION OF A SUB-PIXEL FORMAT DATA TO ANOTHER SUB-PIXEL DATA FORMAT," issued to Elliott et al., discloses a method of converting input image data specified in a first format of primary colors for display on a display panel substantially comprising a plurality of subpixels. The subpixels are arranged in a subpixel repeating group having a second format of primary colors that is different from the first format of the input image data. Note that in U.S. Pat. No. 7,123,277, subpixels are also referred to as "emitters." U.S. Pat. No. 7,123,277 is hereby incorporated by reference herein for all that it teaches.

Figure 18:
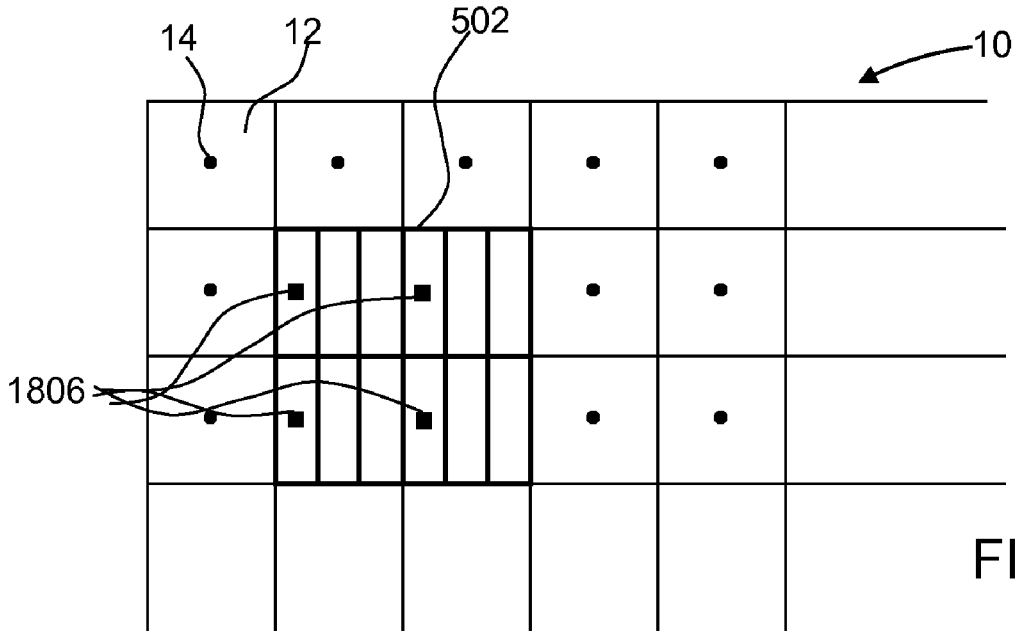
FIG. 18 illustrates the subpixel repeating group of FIG. 5 positioned on a two-dimensional spatial grid of source image data, and further showing examples of red reconstruction points for the subpixel repeating group of FIG. 5 superimposed thereon.

With reference to FIG. 18, in one embodiment, the subpixel rendering operation (SPR) may generally proceed as follows. The color image data values of the source image data may be treated as a two-dimensional spatial grid 10 that represents the source image signal data, as shown for example in FIG. 18. Recall that a gamut mapping operation 1404 (FIG. 16A) may optionally convert source image data representing the input image to be displayed to RGBW data values. Thus, in one embodiment, each image sample area 12 of the grid represents the RGBW color values representing the color at that spatial location or physical area of the image. Each image sample area 12 of the grid, which may also be referred to as an implied sample area, is further shown with a sample point 14 centered in input image sample area 12.

When a display panel such as display panel 1570 of FIG. 17 comprises the plurality of subpixel repeating group 502, the display panel is assumed to have addressble dimensions similar to the input image sample grid 10 of FIG. 18, considering the use of overlapping logical pixels explained herein. The location of each primary color subpixel on display panel 1570 approximates what is referred to as a reconstruction point (or resample point) used by the subpixel rendering operation to reconstruct the input image represented by spatial grid 10 on display panel 1570 of FIG. 17. FIG. 18 shows subpixel repeating group 502 overlaid on four input image sample areas 12 of sample grid 10, with exemplary reconstruction points 1806 for the red subpixels in subpixel repeating group 502. Each reconstruction point 1806 is centered inside an area of the display panel referred to as a resample area (not shown in FIG. 18), and so the center of each subpixel may be considered to be the resample point of the subpixel. The set of subpixels on the display panel for each primary color is referred to as a primary color plane, and the plurality of resample areas for one of the primary colors comprises a resample area array for that color plane.

In one embodiment illustrated herein, the luminance value for a particular subpixel is computed using what is referred to as an "area resample function." The luminance value for the subpixel represented by one of the resample points 1806 is a function of the ratio of the area of each of the input image resample area that is overlapped by the resample area of resample point 1806 to the total area of its respective resample area. The area resample function is represented as an image filter, with each filter kernel coefficient representing a multiplier for an input image data value of a respective input image sample area. More generally, these coefficients may also be viewed as a set of fractions for each resample area. In one embodiment, the denominators of the fractions may be construed as being a function of the resample area and the numerators as being the function of an area of each of the input sample areas that at least partially overlaps the resample area. The set of fractions thus collectively represent the image filter, which is typically stored as a matrix of coefficients. In one embodiment, the total of the coefficients is substantially equal to one. The data value for each input sample area is multiplied by its respective fraction and all products are added together to obtain a luminance value for the resample area.

With continued reference to FIG. 18, in the case of the red resample area array for subpixel repeating group 1502, there is one red source image data value available for each resample point 1806. Thus, in one embodiment, the subpixel rendering operation may simply employ what is referred to as a unity filter to obtain the luminance value for the red subpixels represented by resample points 1806. That is, the red source image data value may be directly used for the value assigned to the red subpixels on the display panel. It can be seen that a unity filter may also be used for reconstructing luminance values for the green subpixels on the display panel, since there is one green source image data value available for each green resample point on the display panel.

Figure 19:
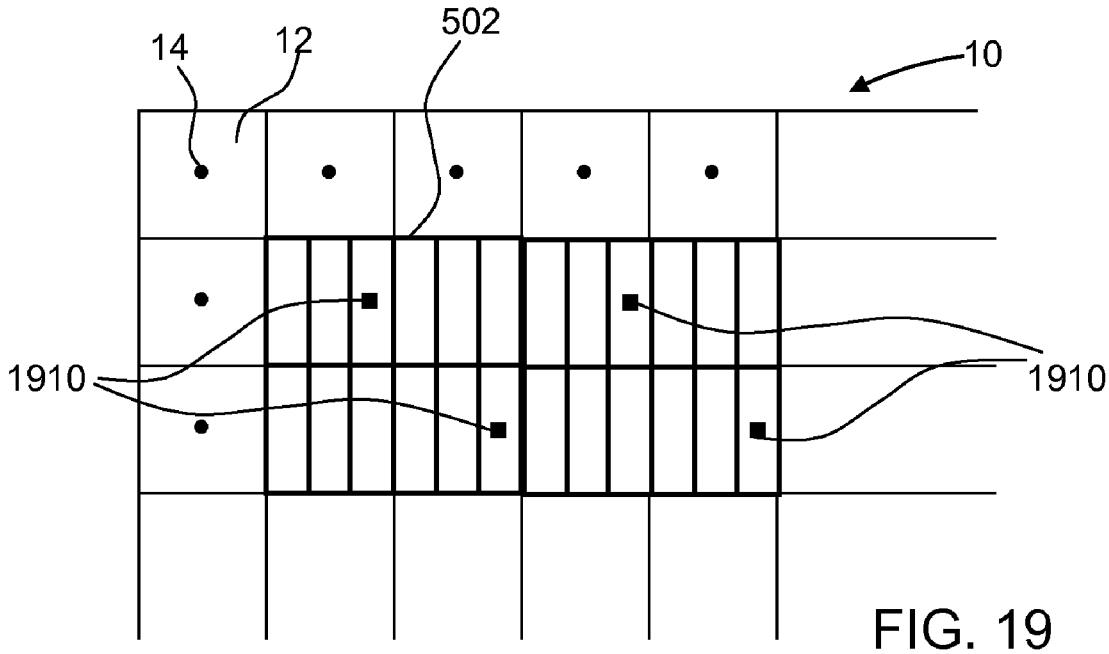
FIG. 19 illustrates the subpixel repeating group of FIG. 5 positioned on a two-dimensional spatial grid of source image data, and further showing examples of blue reconstruction points for the subpixel repeating group of FIG. 5 superimposed thereon.

When display panels are configured with various embodiments of subpixel repeating groups illustrated herein in which the blue subpixels occur at one-half the resolution of the blue source image data, the subpixel rendering operation for the blue subpixels is handled differently. With reference to FIG. 19, subpixel repeating group 502 is again shown overlaid on four input image sample areas 12 of sample grid 10, with exemplary reconstruction points 1910 for the blue subpixels in subpixel repeating group 502. It can be seen that there are four blue source image data values (as represented by the four source image sample areas) that need to be mapped to two occurrences of blue subpixels on the display panel within each subpixel repeating group. A simple average of two blue source image data values may be employed for the blue color plane, such that the blue color plane is resampled using a 1×1 box filter of (0.5, 0.5). Alternatively, each resample area for a blue reconstruction point may extend to three source image sample areas, and what is called a "tent filter" may be used, as follows:

| | | |
|---|---|---|
| 0.25 | 0.5 | 0.25. |

Subpixel rendering operations for subpixel repeating groups having white subpixels is discussed in detail in US 2005/0225563. US 2005/0225563 discloses that input image data may be processed as follows: (1) Convert conventional RGB input image data (or data having one of the other common formats such as sRGB, YCbCr, or the like) to color data values in a color gamut defined by R, G, B and W, if needed. This conversion may also produce a separate Luminance (L) color plane or color channel. (2) Perform a subpixel rendering operation on each individual color plane. (3) Use the "L" (or "Luminance") plane to sharpen each color plane. The reader is referred to US 2005/0225563 for additional information regarding subpixel rendering processing related to white subpixels, and to performing image sharpening operations.

Figure 20:
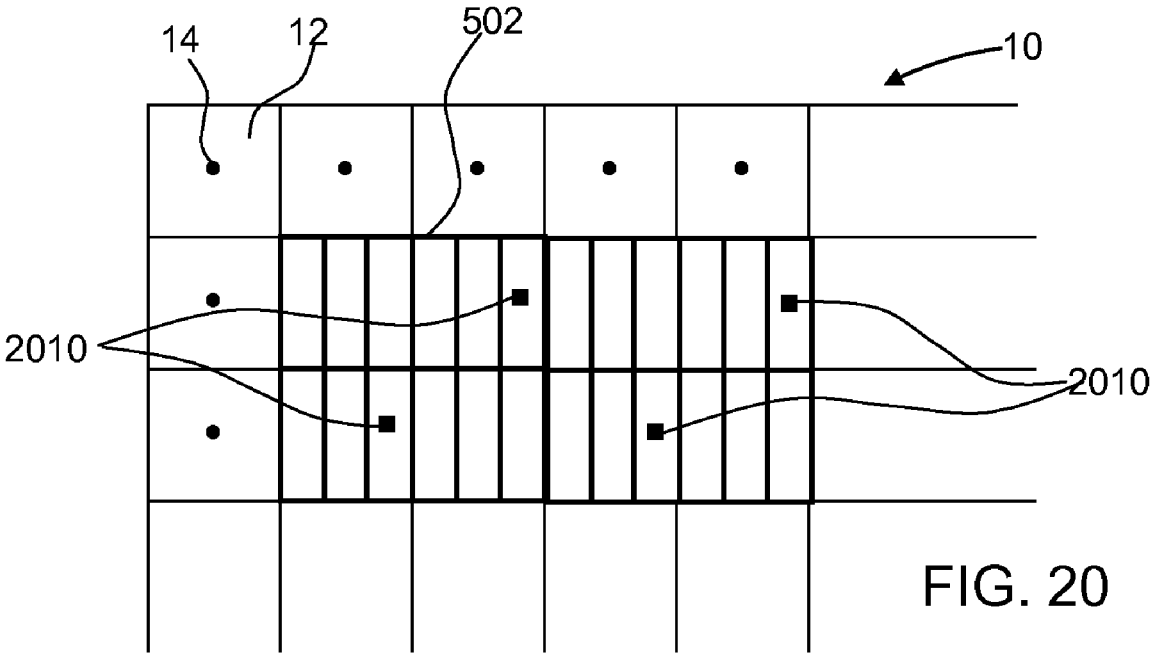
FIG. 20 illustrates the subpixel repeating group of FIG. 5 positioned on a two-dimensional spatial grid of source image data, and further showing examples of white reconstruction points for the subpixel repeating group of FIG. 5 superimposed thereon.

With reference to FIG. 20, subpixel repeating group 502 is again shown overlaid on four input image sample areas 12 of sample grid 10, with exemplary reconstruction points 2010 for the white subpixels in subpixel repeating group 502. It can be seen that white subpixels also occur at one-half the resolution of the white image data that is produced by GMA operation 1404; that is, each of the four implied sample areas 12 overlaid by subpixel repeating group 502 includes a white data component produced by GMA operation 1404 that may be mapped to the two white subpixels in the subpixel repeating group 502.

Several processing alternatives are available for the white subpixels. In one embodiment, the SPR operation may obtain luminance values for the white subpixels in the manner discussed above for the blue subpixels. In another embodiment, a unity filter may be used. That is the white component in the image data overlaid by the white subpixel may be mapped to the white subpixel while letting the red and green subpixels carry the luminance data for the portion of subpixel repeating group 502 that does not contain a white subpixel.

Figure 21A:
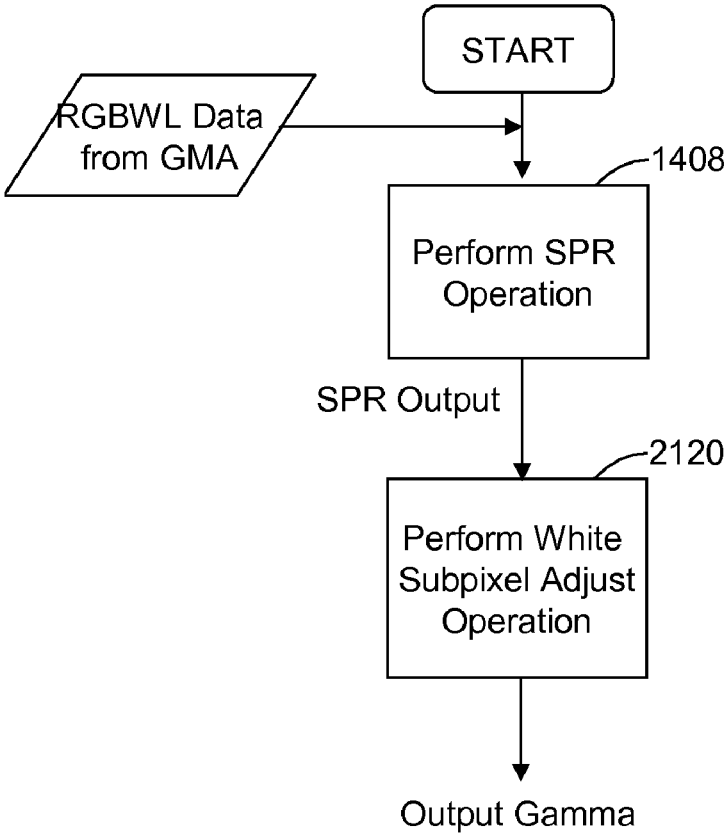
FIGS. 21A and 21B are functional block diagrams of two embodiments of a white subpixel adjustment operation.
Figure 21B:
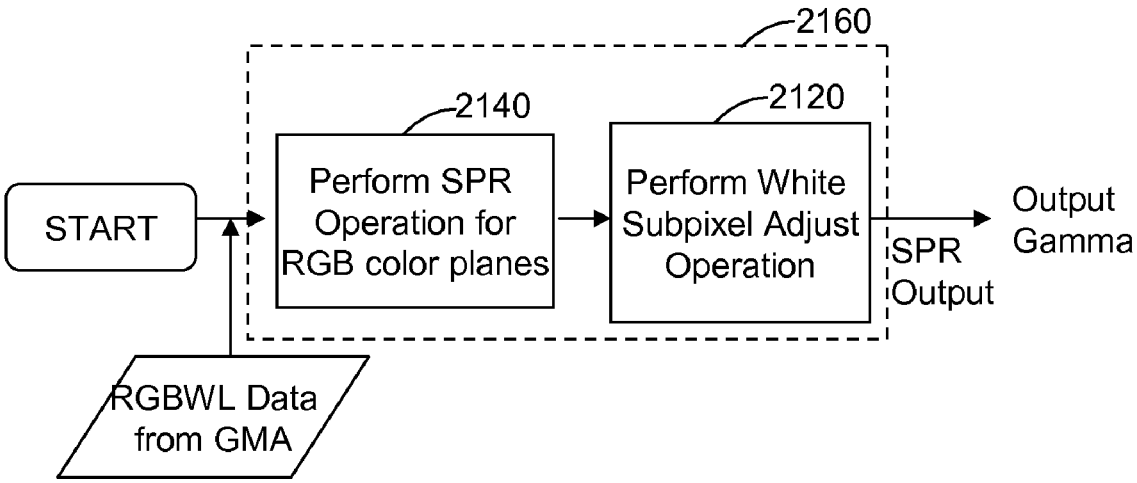

In still another embodiment, a white subpixel adjustment operation may be implemented as part of, or separately from, the SPR operation. The white subpixel adjustment operation may be implemented in place of the filtering operation embodiments just mentioned, or may be performed after the SPR filtering operation on the white color plane. FIGS. 21A and 21B are functional block diagrams that illustrate two possible processing embodiments. In the embodiment of FIG. 21A, the value of the white subpixels computed by SPR operation 1408 is adjusted by white subpixel adjust operation 2120. In the embodiment of FIG. 22A, the SPR operation 2140 computes values for the red, green and blue color planes, as discussed above, and white subpixel adjust operation 2120 computes the brightness values for the white subpixels. Operations 2140 and 2120 may be combined into one SPR operation 2160.

The white subpixel adjustment operation is tailored to the display of certain image features on display panels configured with any one of the embodiments of the subpixel repeating groups described and illustrated herein. On these types of display panels, it may be observed that the brightness of the white subpixel may affect the quality of the appearance of high contrast image features such as, for example, fine text in a black font on a white background. The subpixel rendering operation described above may be enhanced with processing that detects the presence of white subpixels in locations of the image where high spatial frequency features, such as text, occur. These image areas are characterized by the presence of edges, or image areas where there is a change in luminance from one subpixel to the next. Examples of types of image quality concerns include (1) text or lines in a black font that appears blurred or distorted against a white or light-colored background; (2) text or lines in a black font that appears too dark (or bold) against a white or light-colored background; and (3) text or lines in a white font that appears too bright against a black or dark-colored background. The processing described below may apply to image features that contain edges in vertical, horizontal and diagonal directions. White subpixel adjustment operation 2120, in effect, "tunes" the brightness of the white subpixels in the output image to improve areas of the image that contain high spatial frequency features. In hardware terms, the level of white subpixel adjustment may be set with a controllable register. The discussion now turns to four embodiments for implementing white subpixel adjustment operation 2220.

Figure 22:
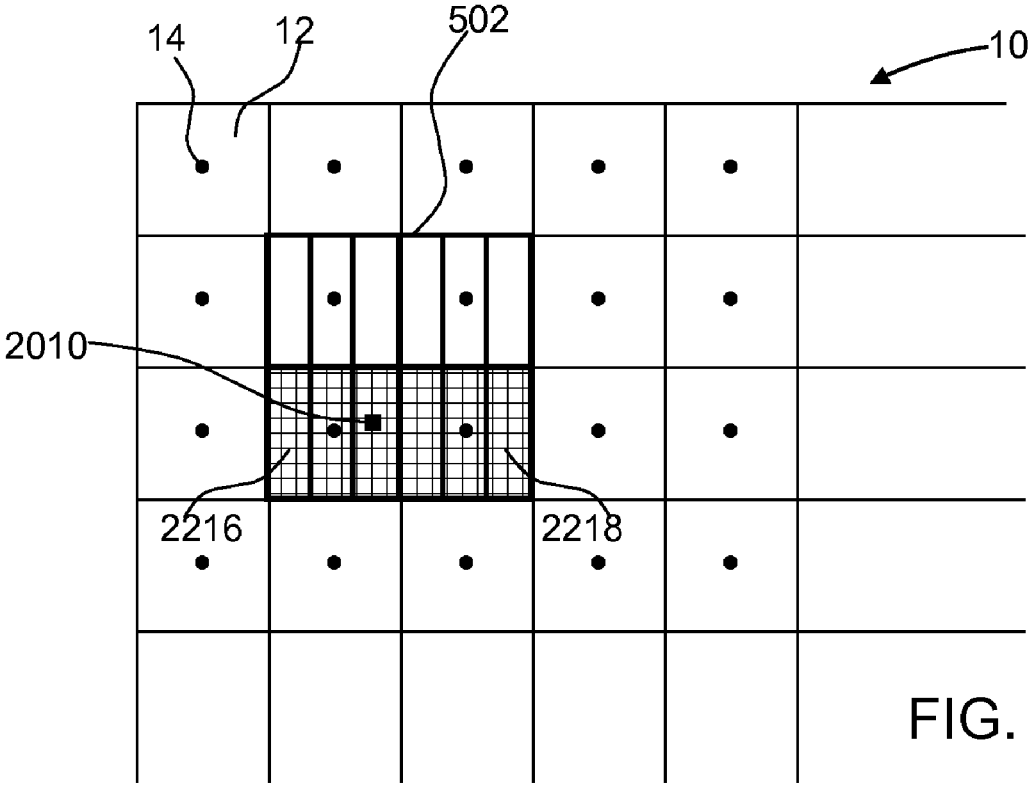
FIGS. 22 and 23 illustrates the subpixel repeating group of FIG. 5 positioned on a two-dimensional spatial grid of source image data, and further showing examples of source image data pixels that may be used to compute a value for a white subpixel in the output image.

FIG. 22 illustrates subpixel repeating group 502 shown overlaid on four input image sample areas 12 of sample grid 10, with exemplary reconstruction point 2010 for the white subpixel in the second row of subpixel repeating group 502. To compute the value for white subpixel 2010, calculate the average of the white data value for source image pixel 2216 that includes white subpixel 2010 and the white data value for an adjacent one of the source image pixels 2218 that does not include a white subpixel to produce white subpixel value, W. Then, calculate the difference in luminance, denoted here as ΔL, between the white data value for source image pixel 2216 and the white data value for adjacent source image pixel 2218. In FIG. 22, adjacent source image pixel 2218 to the right of source image pixel 2216 is selected for this calculation, but any one of the adjacent source image pixels that does not include a white subpixel may be used. Mulitply the absolute value of ΔL by a scaling factor, denoted as S1, to produce the white adjustment quantity, denoted here as W-adjust, and then subtract W-adjust from the computed value W for white subpixel 2010. Scaling factor S1 may be empirically chosen from testing several scaling factors to see which provides the most observable improvement in image quality on the particular display panel. In one embodiment, it was found that a value of 0.5 for S1 provided an acceptable improvement in image quality for high spatial frequency portions of the image.

Figure 23:
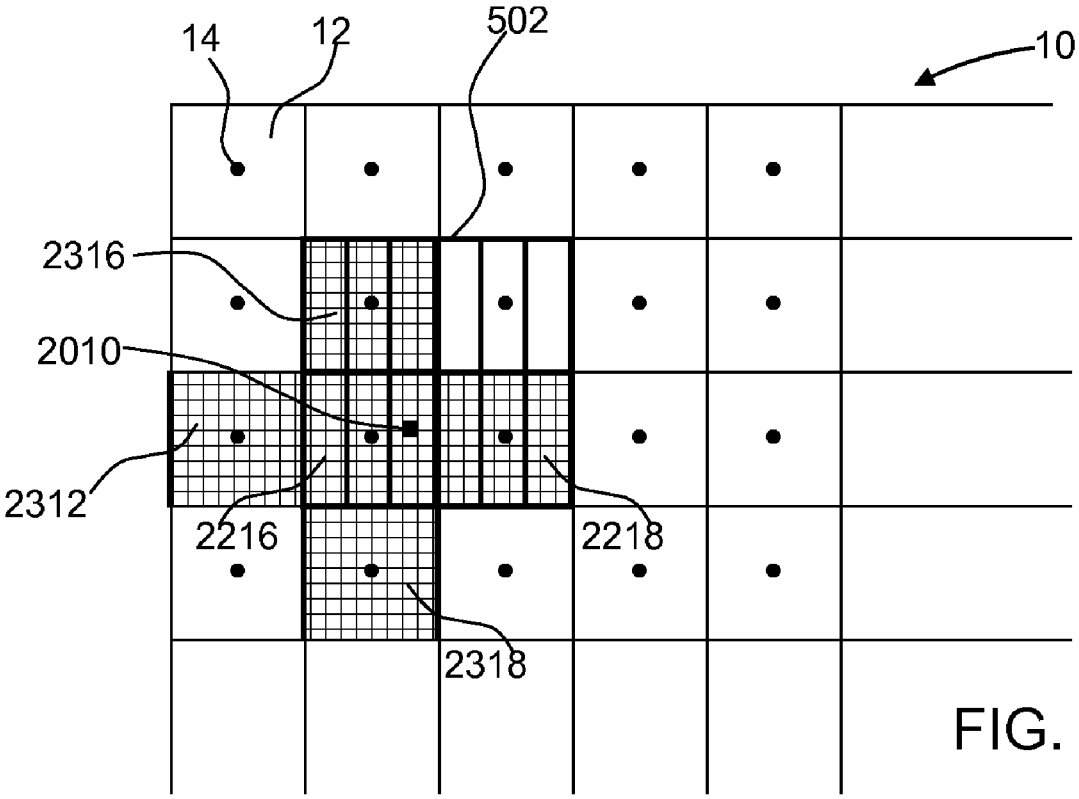

The basic white subpixel adjust operation 2220 described in conjunction with FIG. 22 may be expanded when some image features in some or all displayed image are displayed with too much brightness because the procedure fails to capture a sufficient amount of high spatial frequency features. In a second embodiment, FIG. 23 illustrates that the white data values in additional neighboring source image pixels may also be examined to compute a white subpixel adjustment value. In particular, the white data values for source image pixel 2218 to the right of white subpixel 2010, source image pixel 2312 to the left of white subpixel 2010, source image pixel 2316 above white subpixel 2010, and source image pixel 2318 below white subpixel 2010 are part of the computation of the value for white subpixel 2010. In general, this embodiment looks for the maximum white data value among these white source image data values.

As in the embodiment described in FIG. 22, the average of the white data value for source image pixel 2216 that includes white subpixel 2010 and the white data value for an adjacent one of the source image pixels 2218 that does not include a white subpixel is calculated to produce a white subpixel value, W. The maximum white data value, denoted Wmax, is computed from the five white source image data values. The minimum white data value, denoted Wmin, is computed from the five white source image data values. These two values, Wmax and Wmin, are then compared. If the absolute value of Wmax is greater than the absolute value of Wmin, then the white average value, W, is decreased by the quantity of Wmax multipled by scale factor, S1. If the absolute value of Wmax is less than absolute value of Wmin and Wmin<0, then the average value of white, W, is increased by the quantity of Wmin multiplied by a second scale factor, denoted S2. Scaling factor S2 may also be empirically chosen from testing several scaling factors to see which provides the most observable improvement in image quality on the particular display panel. In one embodiment, it was found that a value of 0.5 for S2 provided an acceptable improvement in image quality for high spatial frequency portions of the image. There is no requirement, however, that the two scaling factors S1 and S2 be the same quantity.

With continued reference to FIG. 23, in a third embodiment, the average of white data values in the neighboring source image pixels may be examined to compute a white subpixel adjustment value. In this embodiment, the average white date value, denoted Wavg, is computed for the five white data values for source image pixel 2216, source image pixel 2218, source image pixel 2312, source image pixel 2316, and source image pixel 2318. If Wavg is >0, the white value of source pixel 2216 containing white subpixel 2010 is adjusted by subtracting the quantity of Wavg multiplied by S1. If Wavg is <0 (i.e., Wavg is negative), the white value of source pixel 2216 containing white subpixel 2010 is adjusted by subtracting the negative quantity of Wavg multiplied by S2, which results in increasing the W value for subpixel 2010.

In a fourth embodiment, a weighted brightness value for white subpixel 2010 is calculated in order to spread out the luminance of white among 3 pixels, In this embodiment, white subpixel value, W is first assigned the white data value for source image pixel 2216 that includes white subpixel 2010. The average white date value, denoted Wavg, is computed for the four white data values adjacent to source image pixel 2216; that is, source image pixel 2218, source image pixel 2312, source image pixel 2316, and source image pixel 2318. The maximum white data value, denoted Wmax, is computed from the same four white source image data values. The minimum white data value, denoted Wmin, is also computed from the same four white source image data values. These two values, Wmax and Wmin, are then compared. If the absolute value of Wmax is greater than or equal to the absolute value of Wmin and Wmax>0, then the white value, W, is adjusted by a weighting filter, denoted WF. Filter WF uses the white data values of the source image pixel 2312 to the left of source image pixel 2216 that includes white subpixel 2010, and of source image pixel 2218 to the right of source image pixel 2216 to produce the weighted w value, denoted Wwf for white subpixel 2010. The quantity of Wmax multipled by scale factor, S1 is then subtracted from the weighted W value, Wwf. If the white data value of right adjacent subpixel 2218 is greater than 1 and the absolute value of Wmax is less than absolute value of Wmin and Wmin<0, then the white value, W, is adjusted by weighting filter, WF, to produce the weighted w value, denoted Wwf. The quantity of Wmin multipled by scale factor, S2 is then subtracted from the weighted W value, Wwf. When neither of these conditions is true, the W value is not adjusted.

In this fourth embodiment, a suitable weighting filter WF of (0.5, 1, 0.5) may be used. The strength of the filter may be adjusted by changing the parameter "weight". In addition, either the average of the difference or the maximum of the difference can be used to adjust the luminance value, W. In this embodiment, single stroke fonts will be somewhat broader than for the other embodiments discussed herein.

Variations of these embodiments for computing a brightness level for the white subpixels are also contemplated.

In the embodiments illustrated in the disclosure, the value of a white subpixel is sometimes diminished as the spatial frequency features in the image increase. For example, single stroke black lines require less white than a broader stroke area in order to preserve the visual appearance of an appropriate line "weight". To preserve the color appearance of white for all spatial frequencies, it may be desirable to change the color data values of the source image pixels using an adjustment that is a function of the magnitude of the difference between the white subpixel and its neighbors. For example, if the white subpixel color point is bluer than the sum of 2R+2G+B, then as brightness level of the white subpixel is diminished, the color point of a white line will shift towards yellow. In this case, red and green data values could be decreased by a pre-determined or computed quantity to maintain a balanced white. If pre-determined scaling factors are used, they may be stored in a lookup table. These quantities may be calculated based on empirical data measured on the panel.

It will be understood by those skilled in the art after reviewing the present disclosure that various changes may be made to the exemplary embodiments illustrated herein, and equivalents may be substituted for elements thereof, without departing from the scope of the teachings provided herein. Therefore, it is intended that the present disclosure should be seen to include all embodiments falling within the scope of its teachings, and not be limited to any particular exemplary embodiment disclosed herein.

What is claimed is:

1. A display device comprising:

a display panel having a display area substantially populated by repetition of a subpixel repeating group;

said subpixel repeating group having first and second rows and plural columns defining a matrix of subpixels, with each subpixel defined as having a respective subpixel color and where the subpixel colors of the subpixels in the subpixel repeating group include first, second, third and fourth primary colors arranged in the first and second rows of the subpixel repeating group, wherein one of said first, second, third and fourth primary colors is white and remaining primary colors of the subpixel repeating group are saturated non-white colors;

wherein the plural columns of said subpixel repeating group include a first column, a second column and a third column, the first column consisting of subpixels of said first primary color and the third column consisting of subpixels of said second primary color such that when copies of the subpixel repeating group are tiled vertically one above the next, the first column forms a vertical stripe of subpixels of its respective first primary color, the third column forms a vertical stripe of subpixels of its respective second primary color;

wherein the second column includes subpixels of both of the third and fourth primary colors disposed in an alternating pattern in the second column;

an input image data unit configured to receive source image data defining a plurality of source image pixels each with a same set and organization of primary source colors, the plurality of source image pixels defining an image; and a subpixel rendering unit configured to subpixel render said received source image data for thereby substantially rendering the image defined by the source image data on said display panel in a form of generating signals representing firstly subpixel rendered luminance levels for corresponding subpixels of the subpixel repeating group;

wherein said subpixel rendering unit is further configured to perform a white subpixel adjustment operation for adjusting luminance levels of firstly subpixel rendered ones of said white subpixels using white data values of source image pixels in said source image data.

2. The display device of claim 1 wherein said source image data defines its plurality of source image pixels in terms of only three saturated primary colors; and wherein said display device further comprises a gamut mapping unit for mapping said source image data into gamut mapped signals representing said first, second, third and fourth primary colors.

3. The display device of claim 1 wherein said white subpixel adjustment operation adjusts the brightness level of a white subpixel using a difference between white data values in adjacent source image data pixels.

4. The display device of claim 1 wherein said white subpixel adjustment operation adjusts the brightness level of a white subpixel using a maximum absolute value of a difference between white data values in adjacent source image data pixels.

5. The display device of claim 1 wherein said white subpixel adjustment operation adjusts the brightness level of a white subpixel using an absolute value of a difference between white data values in adjacent source image data pixels.

6. The display device of claim 1 wherein said white subpixel adjustment operation adjusts the brightness level of a white subpixel using a scaling factor.

7. The display device of claim 1 wherein said subpixel rendering unit performs area resampling of said source image data to produce luminance values for each of the subpixels of the display panel having said subpixel repeating group.

8. The display device of claim 1 wherein said source image data is specified in said three saturated primary colors of the subpixels;

wherein said display device further comprises a gamut mapping unit for mapping said source image data from a color gamut area whose bounds are defined by said three saturated primary colors to a color gamut area whose bounds are defined by said first, second, third and fourth primary colors such that each source image data pixel area is defined to include a white luminance data value; and wherein said white subpixel adjustment operation adjusts the luminance data value of a respective white subpixel of the display area by:

(a) calculating an average of white luminance data values for two adjacent source image pixels to produce a respective white subpixel value, W;

(b) calculating a difference in luminance, $\Delta L$, between said white luminance data values for two adjacent source image pixels;

(c) multiplying an absolute value of $\Delta L$ by a predetermined scaling factor, S1, to thereby produce a white adjustment quantity, W-adjust, and subtracting W-adjust from W.

* * * * *